US006583582B2

(12) United States Patent
Ichikawa

(10) Patent No.: US 6,583,582 B2
(45) Date of Patent: Jun. 24, 2003

(54) METHOD OF DRIVING ELECTRON SOURCE AND IMAGE-FORMING APPARATUS AND METHOD OF MANUFACTURING ELECTRON SOURCE AND IMAGE-FORMING APPARATUS

(75) Inventor: Takeshi Ichikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/967,964

(22) Filed: Oct. 2, 2001

(65) Prior Publication Data

US 2002/0041163 A1 Apr. 11, 2002

(30) Foreign Application Priority Data

Oct. 4, 2000 (JP) ..... 2000-304749
Sep. 27, 2001 (JP) ..... 2001-298394

(51) Int. Cl.[7] ..... H09G 3/10
(52) U.S. Cl. ..... 315/169.3; 315/169.4; 313/505
(58) Field of Search ..... 315/169.3, 169.4, 315/174, 169.1; 313/399, 400, 420, 458, 505, 500; G09G 3/10

(56) References Cited

U.S. PATENT DOCUMENTS

| | | | | |
|---|---|---|---|---|
| 3,681,650 | A | 8/1972 | Koll | 315/30 |
| 4,084,259 | A | 11/1978 | Cahill et al. | 364/900 |
| 4,313,124 | A | 1/1982 | Hara | 346/140 |
| 4,345,262 | A | 8/1982 | Shirato et al. | 346/140 |

(List continued on next page.)

FOREIGN PATENT DOCUMENTS

| | | | | |
|---|---|---|---|---|
| EP | 0036296 | A2 | 9/1981 | B41J/3/04 |
| EP | 0291300 | A2 | 11/1988 | H04N/1/40 |
| EP | 0392753 | A3 | 10/1990 | H04N/1/387 |
| EP | 0526205 | A2 | 2/1993 | B41J/2/505 |

(List continued on next page.)

OTHER PUBLICATIONS

US 6,028,575, 2/2000, Todokoro et al. (withdrawn)
M. Hartwell et al., *Strong Electron Emission from Patterned Tin–Indium Oxide Thin Films*, International Electron Devices Meeting, Washington, D.C. (1975) pp. 519–521.
M.L. Elinson et al., *The Emission of Electrons and the Field Emission of Electrons from Tin Oxide*, Radio Engineering and Electronic Physics (1965) pp. 1290–1296.
C.A. Spindt et al., *Physical Properties of Thin–Film Field Emission Cathodes with Molybdenum Cones*, J. Appl. Phys., vol. 47, No. 12 (1976) pp. 5248–5263.

(List continued on next page.)

*Primary Examiner*—Don Wong
*Assistant Examiner*—Trinh Vo Dinh
(74) *Attorney, Agent, or Firm*—Fitzpatrick, Cella, Harper & Scinto

(57) ABSTRACT

There are provided a method of properly driving an electron source, in matrix driving in which each signal line and scanning line have large capacitance and are capacitively coupled to disturb each other, without any influence of the disturbance, an electron source using the driving method, an image-forming apparatus, and a method of driving the image-forming apparatus. In an electron source made up of electron-emitting devices each having a gate electrode and cathode electrode, in performing passive matrix driving operation of driving a plurality of signal lines together after selecting a scanning, letting $V_{1off}$ be the OFF voltage of the scanning line and $V_{2on}$ be the ON voltage of a signal line, $V_{1off}>V_{2on}-$. In addition, $V_{1off}-V_{2on}$ is set to be large enough to prevent a gate/cathode voltage from changing to the ON region during an OFF period even if the voltage changes due a disturbance caused by driving. Letting $V_{1on}$ be the ON voltage of a scanning line and $V_{2off}$ be the OFF voltage of a signal line, $V_{1on}>V_{2off}$ and $V_{1off}-V_{2on}>V_{1on}-V_{2off}$.

40 Claims, 13 Drawing Sheets

U.S. PATENT DOCUMENTS

| | | | | | |
|---|---|---|---|---|---|
| 4,449,150 | A | | 5/1984 | Kato | 358/283 |
| 4,459,600 | A | | 7/1984 | Sato et al. | 346/140 |
| 4,463,359 | A | | 7/1984 | Ayata et al. | 346/1.1 |
| 4,558,333 | A | | 12/1985 | Sugitani et al. | 346/140 |
| 4,578,714 | A | | 3/1986 | Sugiura et al. | 358/283 |
| 4,608,577 | A | | 8/1986 | Hori | 346/140 |
| 4,660,077 | A | | 4/1987 | Kawanura et al. | 358/75 |
| 4,680,596 | A | | 7/1987 | Logan | 346/140 |
| 4,723,129 | A | | 2/1988 | Endo et al. | 346/1.1 |
| 4,725,849 | A | | 2/1988 | Koike et al. | 346/1.1 |
| 4,740,796 | A | | 4/1988 | Endo et al. | 346/1.1 |
| 4,860,026 | A | | 8/1989 | Matsumoto et al. | 346/1.1 |
| 4,939,583 | A | | 7/1990 | Tsuboi et al. | 358/261.1 |
| 4,951,157 | A | | 8/1990 | Koh et al. | 358/433 |
| 4,969,204 | A | | 11/1990 | Melnychuck | 382/56 |
| 4,999,618 | A | * | 3/1991 | Inada et al. | 315/169.3 |
| 5,020,120 | A | | 5/1991 | Weldy | 382/56 |
| 5,048,111 | A | | 9/1991 | Jones et al. | 382/56 |
| 5,050,101 | A | | 9/1991 | Kiuchi et al. | 364/519 |
| 5,050,230 | A | | 9/1991 | Jones et al. | 382/56 |
| 5,060,285 | A | | 10/1991 | Dixit et al. | 382/56 |
| 5,086,487 | A | | 4/1992 | Katayama et al. | 382/56 |
| 5,111,302 | A | | 5/1992 | Chan et al. | 358/298 |
| 5,124,811 | A | | 6/1992 | Ohsawa | 358/448 |
| 5,136,396 | A | | 8/1992 | Kato | 358/426 |
| 5,138,672 | A | | 8/1992 | Hirabayashi et al. | 382/54 |
| 5,153,749 | A | | 10/1992 | Katayama | 358/448 |
| 5,159,468 | A | | 10/1992 | Yoshida et al. | 358/451 |
| 5,185,813 | A | | 2/1993 | Tsujimoto | 382/240 |
| 5,233,366 | A | | 8/1993 | Stephany | 347/15 |
| 5,270,738 | A | | 12/1993 | Takahashi et al. | 346/140 |
| 5,291,245 | A | | 3/1994 | Charnitski et al. | 355/208 |
| 5,327,254 | A | | 7/1994 | Daher | 358/261.1 |
| 5,430,469 | A | | 7/1995 | Shioya et al. | 347/15 |
| 5,521,717 | A | | 5/1996 | Maeda | 358/426 |
| 5,838,293 | A | * | 11/1998 | Kondoh | 345/97 |
| 5,914,731 | A | | 6/1999 | Yano et al. | 347/9 |
| 5,939,823 | A | | 8/1999 | Kiyomiya et al. | 313/495 |
| 5,989,404 | A | | 11/1999 | Kiyomiya et al. | 205/96 |
| 6,040,973 | A | * | 3/2000 | Okamoto et al. | 315/169.1 |
| 6,057,636 | A | | 5/2000 | Sakai et al. | 313/306 |
| 6,069,620 | A | * | 5/2000 | Nakamura et al. | 345/214 |
| 6,144,435 | A | * | 11/2000 | Yokoyama et al. | 349/122 |
| 6,169,528 | B1 | | 1/2001 | Oguchi et al. | 345/74 |
| RE37,083 | E | * | 3/2001 | Kanazawa | 313/585 |
| 6,339,414 | B1 | | 1/2002 | Todokoro et al. | 345/74.1 |
| 6,400,091 | B1 | * | 6/2002 | Deguchi et al. | 313/495 |
| 6,445,367 | B1 | | 9/2002 | Suzuki et al. | 345/75.2 |
| 2002/0036599 | A1 | * | 3/2002 | Nishimura et al. | 345/11 |

FOREIGN PATENT DOCUMENTS

| | | | | |
|---|---|---|---|---|
| EP | 0526233 | A2 | 2/1993 | B41J/2/205 |
| EP | 0558236 | A2 | 9/1993 | B41J/2/17 |
| EP | 1 037 250 | A1 | 9/2000 | H01J/21/10 |
| FR | 2497043 | | 6/1982 | H04N/1/22 |
| GB | 2219114 | A | 11/1989 | G06F/3/12 |
| JP | 54-56847 | | 5/1979 | B41M/5/26 |
| JP | 55-28862 | | 2/1980 | B41J/33/14 |
| JP | 57-2773 | | 1/1982 | B41J/3/20 |
| JP | 59123670 | | 7/1984 | B41J/3/04 |
| JP | 59138461 | | 8/1984 | B41J/3/04 |
| JP | 60-49953 | | 3/1985 | B41J/3/04 |
| JP | 60-71260 | | 4/1985 | B41J/3/04 |
| JP | 61-228974 | | 10/1986 | B41J/11/42 |
| JP | 63-98455 | | 4/1988 | B41J/3/20 |
| JP | 1267048 | | 10/1989 | B41J/3/04 |
| JP | 2187343 | | 7/1990 | B41J/2/045 |
| JP | 3-46589 | | 2/1991 | G01S/17/08 |
| JP | 4-18358 | | 1/1992 | B41J/2/01 |
| JP | 5-169664 | | 7/1993 | B41J/2/05 |
| JP | 5-212951 | | 8/1993 | B41M/1/26 |
| JP | 8-96703 | | 4/1996 | H01J/1/30 |
| JP | 8-96704 | | 4/1996 | H01J/1/30 |
| JP | 10-149778 | | 6/1998 | H01J/19/24 |
| JP | 2002-063862 | | 2/2000 | H01J/31/12 |
| JP | 2000-251783 | | 9/2000 | H01J/31/12 |
| JP | 2000-268706 | | 9/2000 | H01J/1/304 |

OTHER PUBLICATIONS

Hisashi Araki et al., *Electroforming and Electron Emission of Carbon Thin Films*, (1983) pp. 22–29 (English Abstract on p. 22).

G. Ditmer, *Electrical Conduction and Electron Emission of Discontinuous Thin Films*, Thin Solid Films 9 (1972) pp. 317–328.

C.A. Mead, *Operation of Tunnel–Emission Devices*, Journal of Applied Physics, vol. 32, (1961) pp. 646–652.

W.P. Dyke, et al., *Field Emission*, Advances in Electronics and Electron Physics, vol. III (1956), pp. 90–185.

Hampel et al., "Technical Features of the JBIG Standard for Progressive Bi–Level Image Compression," Signal Processing: Image Communication 4, No. 2 (Apr. 1992), pp. 103–111.

* cited by examiner

METHOD OF DRIVING ELECTRON SOURCE AND IMAGE-FORMING APPARATUS AND METHOD OF MANUFACTURING ELECTRON SOURCE AND IMAGE-FORMING APPARATUS

BACKGROUND OF THE INVENTION

1. Field of the Invention

The present invention relates to a method of driving an electron source having a plurality of electron-emitting devices, an image-forming apparatus using the electron source, a method of driving the apparatus, and a method of manufacturing an electron source and image-forming apparatus.

2. Related Background Art

Conventionally, two types of devices, namely thermionic and cold cathode devices, are known as electron-emitting devices. Known examples of the cold cathode devices are field emission type electron-emitting devices (to be referred to as FE type electron-emitting devices hereinafter), metal/insulator/metal type electron-emitting devices (to be referred to as MIM type electron-emitting devices hereinafter), surface conduction electron-emitting devices.

Known examples of the FE type electron-emitting devices are described in W. P. Dyke and W. W. Dolan, "Field Emission", Advance in Electron Physics, 8, 89 (1956) and C. A. Spindt, "Physical properties of thin-film field emission cathodes with molybdenum cones", J. Appl. Phys., 47, 5248 (1976).

A known example of the MIM type electron-emitting devices is described in C. A. Mead, "Operation of Tunnel-Emission Devices", J. Appl. Phys., 32, 646 (1961).

In addition, the following devices have been recently studied: Toshiaki Kusunoki, "Fluctuation-free Electron Emission from Non-formed Metal-Insulator-Metal (MIM) Cathodes Fabricated by Low Current Anodicoxidation", Jpn. J. Appl. Phys. vol. 32 (1993), pp. L1695, Mutsumi Suzuki et al., "An MIM-Cathode Array for Cathode Luminescent Displays", IDW '96, (1996), pp. 529, and the like.

A known example of surface-conduction electron-emitting devices is described in, e.g., M. I. Elinson, "Radio Eng. Electron Phys., 10 (1965) and other examples will be described later. The surface conduction electron-emitting device utilizes the phenomenon in which electrons are emitted by a small-area thin film formed on a substrate by flowing a current in parallel with the film surface. The surface conduction electron-emitting device includes electron-emitting devices using an $SnO_2$ thin film according to Elinson mentioned above, an Au thin film (G. Dittmer, "Thin Solid Films", 9,317 (1972)), an $In_2O_2/SnO_2$ thin film (M. Hartwell and C. G. Fonstad, IEEE Trans. ED Conf., 519 (1975)), and the like.

Various arrangements of a plurality of electron-emitting devices constituting an electron source are adopted. For example, a matrix arrangement is available, in which a plurality of electron-emitting devices are arranged in the X and Y directions in the form of a matrix, and one electrode of each of the electron-emitting devices arranged on the same row is commonly connected to an X-direction wiring, while the other electrode of each of the electron-emitting devices arranged on the same column is commonly connected to a Y-direction wiring. A matrix arrangement will be described below with reference to FIG. 12.

M X-direction wirings 62 include wirings Dx1, Dx2, . . . , Dxm and can be made of an electroconductive metal or the like formed by vacuum evaporation, printing, sputtering, or the like. A wiring material, thickness, and width are properly designed. Y-direction wirings 63 include n wirings Dy1, Dy2, . . . , Dyn and are formed in the same manner as the X-direction wirings 62. A dielectric interlayer (not shown) is formed between the m X-direction wirings 62 and the n Y-direction wirings 63 to electrically isolate them (both m and n are positive integers).

The dielectric interlayer (not shown) is made of $SiO_2$ or the like formed by vacuum evaporation, printing, sputtering, or the like. The dielectric interlayer is formed in a desired shape on the entire surface or part of the surface of a base member 61 on which the X-direction wirings 62 are formed, and a thickness, material, and manufacturing method are properly set for the interlayer to withstand the potential difference at the intersections of the X-direction wirings 62 and the Y-direction wirings 63, in particular. The X-direction wirings 62 and Y-direction wirings 63 extend as external terminals.

The m X-direction wirings 62 may also serve as the cathode electrodes of the electron-emitting devices. The n Y-direction wirings 63 may also serve as the gate electrodes of the electron-emitting devices. The dielectric interlayer may also serve as a dielectric layer of each electron-emitting device.

A scan signal application means for applying a scan signal for selecting a row of electron-emitting devices 64 arranged in the X direction is connected to the X-direction wirings 62. A modulated signal generating means for modulating data from each column of electron-emitting devices 64 arranged in the Y direction in accordance with an input signal is connected to the Y-direction wirings 63. A driving voltage applied to each electron-emitting device is a difference voltage between a scan signal applied to the device and a modulated signal supplied from a signal line.

SUMMARY OF THE INVENTION

In order to apply an electron-emitting device to an image-forming apparatus, an emission current for making a phosphor emit light with sufficient luminance is required. On the other hand, in setting the electron-emitting device in the OFF state, the electron-emitting device must be controlled without causing it to emit electrons. Obviously, to increase the number of grayscale levels is an important factor in improving image quality. In addition, to realize a high-resolution display, an electron beam applied to a phosphor needs to have a small diameter, and many pixels are required. It is also important that such devices can be easily manufactured.

An example of the conventional FE type electron-emitting device is a Spindt type electron-emitting device. The Spindt type electron-emitting device uses a microchip as an electron-emitting member, and electrons are emitted from the tip of the microchip. As the emission current density is increased to make a phosphor emit light, thermal damage to the electron-emitting portion is induced, thus limiting the life of the FE device. In addition, electrons emitted from the tip tend to diverge due to the electric field formed by the gate electrode. This makes it impossible to reduce the beam diameter.

To overcome such drawbacks of the EF device, various solutions have been proposed.

As an example of a technique of preventing divergence of an electron beam, a technique of placing a focusing electrode above the electron-emitting portion is available. According to this technique, an emitted electron beam is generally focused by the negative potential of the focusing electrode. This complicates the manufacturing process and leads to an increase in manufacturing cost.

As another example of the technique of reducing the diameter of an electron beam, a method without the formation of a microchip like the one formed in Spindt type electron-emitting device is available. For example, such methods are disclosed in Japanese Laid-Open Patent Application Nos. 8-096703 and 8-096704, U.S. Pat. No. 5,939,823, U.S. Pat. No. 5,989,404, and the like.

According to this device, since electron emission is performed from a thin film formed in a hole, a flat equipotential surface is formed on the electron-emitting surface, thereby reducing the divergence of an electron beam.

By using a material with a low work function as an electron-emitting substance, electron emission can be performed without forming any microchip. This makes it possible to realize a low driving voltage. In addition, a manufacturing method is relatively simple. Furthermore, since electron emission is performed on a surface, an electric field does not concentrate, and no chip destruction occurs. The life of this device is therefore long.

According to such FE type electron-emitting devices, an electric field (in general, $1\times10^8$ V/m to $1\times10^{10}$ V/m in the case of the Spindt type) required to emit electrons from a gate electrode near an electron-emitting substance connected to a cathode electrode is applied to the electron-emitting substance. This makes it possible to emit electrons. In general, electrons emitted from electron-emitting devices accelerated by an anode voltage applied to the anode electrode placed above the device and an electric field formed between electron-emitting devices, thus providing sufficient energy. The electrons reaching the anode electrode are trapped by the anode electrode to become an emission current.

In general, the modulated voltage applied between a gate electrode and a cathode electrode is several 10 V to several 100 V. The voltage applied to the anode electrode is several 100 V to several 10 kV. That is, this voltage is several 10 or several 100 times higher than the modulated voltage of the gate electrode.

In general, therefore, to ON/OFF-control the emission of electrons from an electron-emitting device, the voltage between the cathode electrode and the gate electrode is modulated.

An example of the method of driving these electron-emitting devices is disclosed in Japanese Laid-Open Patent Application No. 8-096703. FIG. 14 shows this scheme. In this arrangement, to display a color image, anodes divided for R, G, and B are time-divisionally modulated. Basically, however, an anode electrode is held at a constant value (250 V), and a signal for image display is realized by modulating (20 V) the voltage between a cathode electrode and a gate electrode. In addition, in the OFF state (OFF period), the potentials of the cathode and gate electrodes are equalized, and the voltage between the cathode electrode and the gate electrode is set to 0 V. In addition, the distance between the cathode electrode and the anode electrode is 300 $\mu$m. First of all, a voltage between $-\alpha$ V and $-\beta$ V is applied to a selected cathode electrode, and a voltage of $\alpha$ V is applied to the gate electrode for a desired period of time accordingly. In this case, when $2\alpha$ V is applied between the gate electrode and the cathode electrode, electrons are emitted. In this case, writes are separately performed for R, G, and B. If, however, the potential of the anode electrode is held at a constant value and the potential of the phosphor is not modulated, a batch write may be performed instead of individually driving R, G, and B pixels. At the end of a 1-H period, the selected cathode electrode is set at 0 V, and a voltage between $-\alpha$ V and $-\beta$ V is applied to the cathode electrode selected next. The above operation is then repeated.

If an anode voltage is kept constant, the distance between the cathode electrode and the anode electrode is preferably decreased to reduce the beam diameter. However, in consideration of the easiness of the formation of a vacuum and the prevention of discharge, this distance cannot be decreased to a certain degree or more.

In matrix driving, voltage disturbances are caused by crosstalk due to scanning lines and signal lines and capacitive coupling. When electron-emitting devices are to be arranged in a matrix, the electron-emitting devices are preferably formed in the intersection areas between scanning lines and signal lines in consideration of an increase in electron-emitting area.

On the other hand, since the overlapping area is large, the capacitance between each scanning line and each signal line increases, resulting in voltage disturbances. This point will be described with reference to FIG. 13. FIG. 13 is a timing chart in a case where a plurality of electron-emitting devices (FIG. 12) arranged by matrix wiring are driven (so-called "line-sequential driving").

Referring to FIG. 12, the scanning lines 62 to which scanning signals are applied are scanning lines Dx1 to Dxm, and the signal lines 63 to which modulated signals are applied are signal lines Dy1 to Dyn. The gate electrodes of the electron-emitting devices 64 are connected to the signal lines 63, and the cathode electrodes are connected to the scanning lines 62. A case where m=n=5 will be described below. The anode voltage Va is constant. FIG. 13 shows the waveforms of voltages applied to the scanning lines Dx1 to Dx3 and the waveforms of voltages applied to the signal lines Dy1 to Dy5.

First of all, all the terminals are turned off (For example, all the scanning lines 62 are set at 20 V, and all the signal lines 63 are set at 0 V. With this operation, a voltage of −20 V is applied to the gate electrodes of electron-emitting devices with respect to the cathode electrodes, thus setting all the electron-emitting devices in the OFF state).

A voltage $V_{1on}$ of 0 V in the ON state is applied to the scanning line Dx1. A voltage of 0 V is therefore applied to the cathode electrode of each electron-emitting device connected to the scanning line Dx1. Subsequently, an ON signal $V_{2on}$ is simultaneously applied to the signal lines 63 connected to the electron-emitting devices to be turned on. The ON signal $V_{2on}$ is, for example, a voltage of 20 V, which is applied to the signal lines Dy1 to Dy4. As a result, electrons are emitted from the electron-emitting devices at the intersections of the scanning line Dx1 and the signal lines Dy1 to Dy4. In this embodiment, the signal line Dy5 is kept off for a 1-H period, to which a voltage $V_{2off}$ of 0 V is kept applied.

In time-divisional pulse grayscale display operation, given pixels are simultaneously caused to emit light, and the voltage $V_{2off}$ is applied to sequentially turn off signal lines Dy1 in accordance with the grayscale level. In this case, the three signal lines Dy1 to Dy3 are set at the OFF voltage $V_{2off}$ (0 V) for a period of time ½ 1 H to display a halftone image. The signal line Dy4 is kept ON for a 1-H period in ON state ($V_{2on}$) and finally set at $V_{2off}$.

At the end of a 1-H period, the voltage of the scanning scanning line Dx1 is changed to an OFF voltage $V_{1off}$. Subsequently, the scanning line Dx2 is turned on. And then, the ON voltage $V_{2on}$ is applied to the signal lines Dy1 for a period of time corresponding to the grayscale level by the same driving operation as that for the scanning line Dx1.

This operation is repeated up to all of the scanning line (Dx1 to Dx5), thus completing one frame. The driving method, as described in the above, is called as "line-sequential driving". In this case, for the sake of descriptive convenience, the 5×5 device arrangement is described as an example. In the case of XGA, for example, 1024×768 devices are used. Furthermore, if one pixel is made up of three R, G, and B sub-pixels, 768×1024×3 devices are used.

In this case, when, for example, the scanning line Dx1 is selected, a change in voltage applied to each of the signal lines Dy1, Dy2, and Dy3 will affect other wirings. This problem will be described below.

Capacitances Cd are respectively formed between the scanning line Dx1 and mainly the signal lines Dy1 to Dy5. The scanning line Dx1 has a parasitic capacitance Cpx in addition to the capacitances Cd. That is, the capacitance Co of the scanning line Dx1 is given by Cpx+5Cd. This value is basically common to all the scanning lines (Dx1 to Dx5). On the other hand, a capacitance Coy of a signal line is the sum of a parasitic capacitance Cpy and Cd (the capacitance of a scanning line)×5, i.e., Coy=Cpy+5Cd.

Consider a voltage change at the timing (a point A in FIG. 13) at which the signal lines Dy1 to Dy3 are simultaneously turned off after an ON signal is input to the signal lines Dy1 to Dy4 in the early stage of the operation.

In this case, all the scanning lines Dx1 to Dx5 exhibit the voltage change due to capacitive coupling which is expressed by $\delta V=20\ V\times 3Cd/(Cpy+5Cd)$. If, for example, Cpy=Cd, a voltage drop of about 10 V as $\delta V$ occurs. Since a voltage is applied from a voltage source, this change does not steadily appear as a change in the potential of a scanning line. As shown in FIG. 13, however, a change corresponding to a CR time constant occurs.

Since a voltage of 20 V is applied to the signal line Dy4, an excess of 10 V is applied to the electron-emitting devices at the intersections of the scanning lines Dx2 to Dx5 and the signal line Dy4 (the second waveform from below in FIG. 13 is the waveform of a voltage applied to the electron-emitting device at the intersection of the signal line Dy4 and the scanning line Dx2). If this voltage is lower than the electron emission threshold of the electron-emitting device, the device emits no electron. If the voltage is equal to or higher than the threshold, the device emits electrons. This disturbance may occur the number of times corresponding to the number of scanning lines. This will cause a large disturbance. In a display apparatus, such as a liquid crystal display apparatus, which keeps emitting light during a frame period to obtain an emission intensity based on frame integration, light emission for such a short period of time hardly affects image quality. In an apparatus using electron emission, however, since luminance is obtained by instantaneous light emission, disturbed emitted light directly and greatly affects image quality.

Referring to the timing chart of FIG. 13, another problem lies in the electron-emitting device at the intersection of the scanning line Dx1 and the signal line Dy5. Although a signal representing black display is input to this device, the device may emit light when the voltage of the signal lines Dy1 to Dy3 changes to the OFF voltage. This light emission, however, occurs once in a frame, and hence this problem is less important than the problem associated with the above unselected scanning lines.

If an image-forming apparatus (display) is formed under such conditions and a general driving method is used, pixels that should be in the OFF state may emit light to cause a deterioration in contrast.

The present invention has been made to solve the above problems, and has as its object to provide a method of properly driving ("line sequential driving", in particular) an electron source having a plurality of electron-emitting devices arranged in a matrix without causing any unwanted electron emission, and a high-image-quality, high-resolution image-forming apparatus by using the electron source driven in this manner.

In order to achieve the above object, according to th e prese n t invention, there is provided a method of driving an electron source in which electron-emitting devices, each having a gate electrode and cathode electrode, are arranged in a matrix, comprising the steps of applying a predetermined potential to an anode elec trode formed above the electron-emitting device, controlling an electron emission amount from the electron-emitting device by modulating a potential difference between the cathode electrode and the gate electrode and selecting one of a plurality of first-directional wirings in one of an X direction and a Y direction in which the cathode electrodes of a plurality of electron-emitting devices which are arranged on one side of the same row or column are commonly connected, and driving a plurality of second-directional wirings together in the other of the X direction and the Y direction in which the gate electrode s of the plurality of electron-emitting devices which are arranged on the other side of the same row or column are commonly connected, wherein letting $V_{1off}$ be an OFF voltage of the first-directional wiring, and $V_{2on}$ be an ON voltage of the second-directional wiring, $V_{1off}>V_{2on}$ is satisfied.

Letting $V_{2off}$ be an OFF voltage of the second-directional wiring, C1 be a total capacitance of the first-directional wirings and the second-directional wirings, and CO be a total capacitance of the first-directional wirings, it is preferable to satisfy $V_{1off}-V_{2on}\geqq(V_{2on}-V_{2off})\times C1/CO$.

It is preferable to satisfy $2V_{2on}-V_{1off}-V_{2off}\leqq 0$.

Letting $V_{1on}$ be an ON voltage of the first-directional wiring, it is preferable to satisfy $V_{1on}>V_{2off}$ and $V_{1off}-V_{2on}>V_{1on}-V_{2off}$.

The electron-emitting device is a thin film and placed substantially parallel to the anode electrode.

The electron-emitting device is placed within an intersection area between the first-directional wiring and the second-directional wiring.

In addition, according to the present invention, there is provided a method of driving an electron source in which electron-emitting devices, each having a gate electrode and cathode electrode, are arranged in a matrix, comprising the steps of applying a predetermined potential to an anode electrode formed above the electron-emitting device, controlling an electron emission amount of the electron-emitting device by modulating a potential between the cathode electrode and the gate electrode and selecting one of a plurality of first-directional wirings in one of an X direction and a Y direction in which the cathode electrodes of a plurality of electron-emitting devices which are arranged on one side of the same row or column are commonly connected, and driving a plurality of second-directional wirings together in the other of the X direction and the Y direction in which the gate electrodes of the plurality of electron-emitting devices which are arranged on the other side of the same row or column are commonly connected, wherein letting $V_{1off}$ be an OFF voltage of the first-directional wiring, and $V_{2on}$ be an ON voltage of the second-directional wiring, $V_{1off}$ and $V_{2on}$ are set to satisfy $V_{1off}>V_{2on}$.

Letting $V_{2off}$ be an OFF voltage of the second-directional wiring, C1 be a total capacitance of the first-directional wirings and the second-directional wirings, and CO be a total capacitance of the first-directional wirings, $V_{1off}$, $V_{2on}$, and $V_{2off}$ are set to satisfy $V_{1on}-V_{2on} \geqq (V_{2on}-V_{2off}) \times C1/CO$.

In addition, $V_{1off}$, $V_{2on}$, and $V_{2off}$ are set to satisfy $2V_{2on}-V_{1off}-V_{2off} \leqq 0$.

Furthermore, letting $V_{1on}$ be an ON voltage of the first-directional wiring, $V_{1on}$, $V_{1off}$, and $V_{2on}$ are set to satisfy $V_{1on}>V_{2off}$ and $V_{1off}-V_{2on}>V_{1on}-V_{2off}$.

The electron-emitting device is a thin film and placed substantially parallel to the anode electrode.

The electron-emitting device is placed within an intersection area between the first-directional wiring and the second-directional wiring.

According to the present invention, there is provided an image-forming apparatus comprising the electron source and an image-forming member for forming an image by using electrons emitted from the electron source, wherein a scanning signal is input through the first-directional wiring of the electron source, and a modulated signal is input through the second-directional wiring.

The electron-emitting devices are time-divisionally driven to express a grayscale image.

The image-forming member is a phosphor that emits light upon collision with electrons.

According to the present invention, there is provided a method of driving an image-forming apparatus comprising an electron source having a plurality of electron-emitting devices, each having a gate electrode and a cathode electrode, arranged in a matrix, the electron source having a plurality of first-directional wirings in one of X and Y directions in which the cathode electrodes of the plurality of electron-emitting devices which are arranged on one side of the same row or column are commonly connected, and a plurality of second-directional wirings in the other of X and Y directions in which the gate electrodes of the plurality of electron-emitting devices which are arranged on the other side of the same row or column are commonly connected, and an image-forming member for forming an image by using electrons emitted from the electron-emitting devices, the method of driving the image-forming apparatus by inputting a scanning signal through the first-directional wiring and a modulated signal through the second-directional wiring, wherein the electron source is driven by the driving method.

The electron-emitting devices are time-divisionally driven to express a grayscale image.

The image-forming member is a phosphor that emits light upon collision with electrons.

According to the present invention, there is provided a method of driving an electron source comprising a plurality of electron-emitting devices, each comprising a gate electrode and a cathode electrode, a plurality of row-directional wirings, and a plurality of column-directional wirings, the cathode electrode being connected one of the plurality of row-directional wirings, and the gate electrode being connected to one of the plurality of column-directional wirings, comprising selecting at least one row-directional wiring from the plurality of row-directional wirings, and applying a voltage $V_{1on}$ to the selected wiring, while selecting at least one column-directional wiring from the plurality of column-directional wirings, and applying a voltage $V_{2on}$ to the selected wiring, wherein a voltage $V_{1off}$ is applied to each unselected wiring of the plurality of row-directional wirings, and a voltage $V_{2off}$ is applied to each unselected wiring of the plurality of column-directional wirings, and $V_{1off}>V_{2on}>V_{1on}$ is satisfied.

According to the present invention, there is provided a method of driving an electron source comprising a plurality of electron-emitting devices, each comprising a gate electrode and a cathode electrode, a plurality of row-directional wirings, and a plurality of column-directional wirings, the cathode electrode being connected one of the plurality of column-directional wirings, and the gate electrode being connected to one of the plurality of row-directional wirings, comprising selecting at least one row-directional wiring from the plurality of row-directional wirings, and applying a voltage $V_{1on}$ to the selected wiring, while selecting at least one column-directional wiring from the plurality of column-directional wirings, and applying a voltage $V_{2on}$ to the selected wiring, wherein a voltage $V_{1off}$ is applied to each unselected wiring of the plurality of row-directional wirings, and a voltage $V_{2off}$ is applied to each unselected wiring of the plurality of column-directional wirings, and $V_{1off}<V_{2on}<V_{1on}$ is satisfied.

According to the present invention, there is provided a method of manufacturing an electron source, comprising the steps of (A) preparing an electron source comprising a plurality of electron-emitting devices, each comprising a gate electrode and a cathode electrode, a plurality of row-directional wirings, and a plurality of column-directional wirings, the cathode electrode being connected one of the plurality of row-directional wirings, and the gate electrode being connected to one of the plurality of column-directional wirings, and (B) connecting means for applying a voltage to the plurality of row-directional wirings and the plurality of column-directional wirings, wherein the means for applying the voltage selects at least one row-directional wiring from the plurality of row-directional wirings and applies a voltage $V_{1on}$ to the selected wiring while selecting at least one column-directional wiring from the plurality of column-directional wirings and applying a voltage $V_{2on}$ to the selected wiring, a voltage $V_{1off}$ is applied to each unselected wiring of the plurality of row-directional wirings and a voltage $V_{2off}$ is applied to each unselected wiring of the plurality of column-directional wirings, and $V_{1off}>V_{2on}>V_{1on}$ is satisfied.

According to the present invention, there is provided a method of manufacturing an image-forming apparatus, comprising the steps of (A) preparing a first substrate having an electron source comprising a plurality of electron-emitting devices, each comprising a gate electrode and a cathode electrode, a plurality of row-directional wirings, and a plurality of column-directional wirings, the cathode electrode being connected one of the plurality of row-directional wirings, and the gate electrode being connected to one of the plurality of column-directional wirings, (B) preparing a second substrate having a phosphor, (C) arranging the first and second substrates to oppose each other and holding a space between the first and second substrates in a depressurized state, and (D) connecting a means for applying a voltage to the plurality of row-directional wirings and the plurality of column-directional wirings, wherein the means for applying the voltage selects at least one row-directional wiring from the plurality of row-directional wirings and applies a voltage $V_{1on}$ to the selected wiring while selecting at least one column-directional wiring from the plurality of column-directional wirings and applying a voltage $V_{2on}$ to the selected wiring, a voltage $V_{1off}$ is applied to each unselected wiring of the plurality of row-directional wirings and a voltage $V_{2off}$ is applied to each unselected wiring of the plurality of column-directional wirings, and $V_{1off}>V_{2on}>V_{2on}$ is satisfied.

According to the present invention, there is provided a method of manufacturing an electron source, comprising the steps of (A) preparing an electron source comprising a plurality of electron-emitting devices, each comprising a gate electrode and a cathode electrode, a plurality of row-directional wirings, and a plurality of column-directional wirings, the gate electrode being connected one of the plurality of row-directional wirings, and the cathode electrode being connected to one of the plurality of column-directional wirings, and (B) connecting means for applying a voltage to the plurality of row-directional wirings and the plurality of column-directional wirings, wherein the means for applying the voltage selects at least one row-directional wiring from the plurality of row-directional wirings and applies a voltage $V_{1on}$ to the selected wiring while selecting at least one column-directional wiring from the plurality of column-directional wirings and applying a voltage $V_{2on}$ to the selected wiring, a voltage $V_{1off}$ is applied to each unselected wiring of the plurality of row-directional wirings and a voltage $V_{2off}$ is applied to each unselected wiring of the plurality of column-directional wirings, and $V_{1off}<V_{2on}<V_{1on}$ is satisfied.

According to the present invention, there is provided a method of manufacturing an image-forming apparatus, comprising the steps of (A) preparing a first substrate having an electron source comprising a plurality of electron-emitting devices, each comprising a gate electrode and a cathode electrode, a plurality of row-directional wirings, and a plurality of column-directional wirings, the gate electrode being connected one of the plurality of row-directional wirings, and the cathode electrode being connected to one of the plurality of column-directional wirings, (B) preparing a second substrate having a phosphor, (C) arranging the first and second substrates to oppose each other and holding a space between the first and second substrates in a depressurized state, and (D) connecting a means for applying a voltage to the plurality of row-directional wirings and the plurality of column-directional wirings, wherein the means for applying the voltage selects at least one row-directional wiring from the plurality of row-directional wirings and applies a voltage $V_{1on}$ to the selected wiring while selecting at least one column-directional wiring from the plurality of column-directional wirings and applying a voltage $V_{2on}$ to the selected wiring, a voltage $V_{1off}$ is applied to each unselected wiring of the plurality of row-directional wirings and a voltage $V_{2off}$ is applied to each unselected wiring of the plurality of column-directional wirings, and $V_{off}<V_{2on}<V_{1on}$ is satisfied.

With the above arrangement, the electron source and image-forming apparatus using the method of driving the electron source to which the present invention can be applied can provide a good image in driving high-efficiency electron-emitting devices, each designed to emit an electron beam with a small diameter, by matrix driving, without any influences of voltage disturbances due to driving on image quality.

DETAILED DESCRIPTION OF THE PREFERRED EMBODIMENTS

A preferred embodiment of the present invention will be described in detail below with reference to the accompanying drawings. Note that the present invention is not limited to sizes, materials, and shapes of the components described in this embodiment and their relative positions described in this embodiment unless otherwise specified, and is not limited to the conditions described below, e.g., the voltages applied to cathode, gate, and anode electrodes and the driving waveforms unless otherwise specified.

Figure 1A:
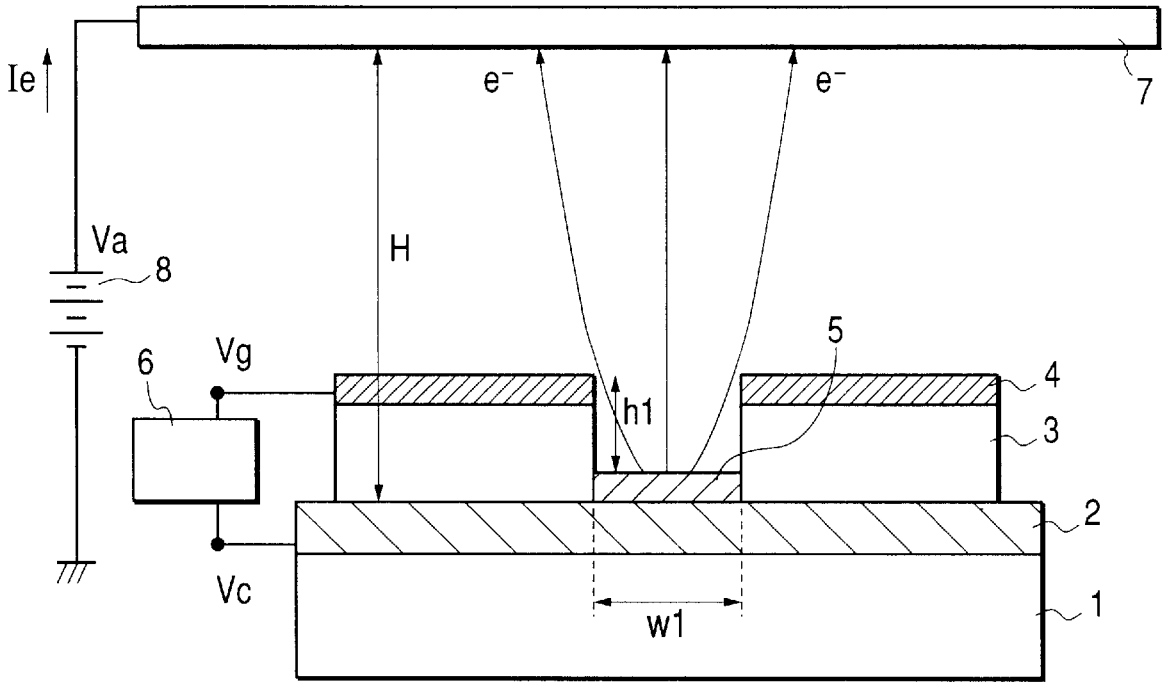
FIGS. 1A and 1B are views showing the basic structure of an electron-emitting device which can be applied to the present invention.
Figure 1B:
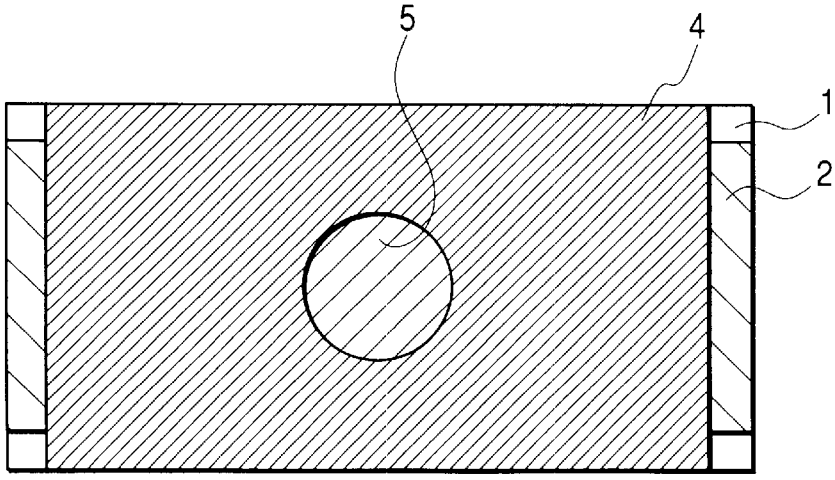
Figure 2:
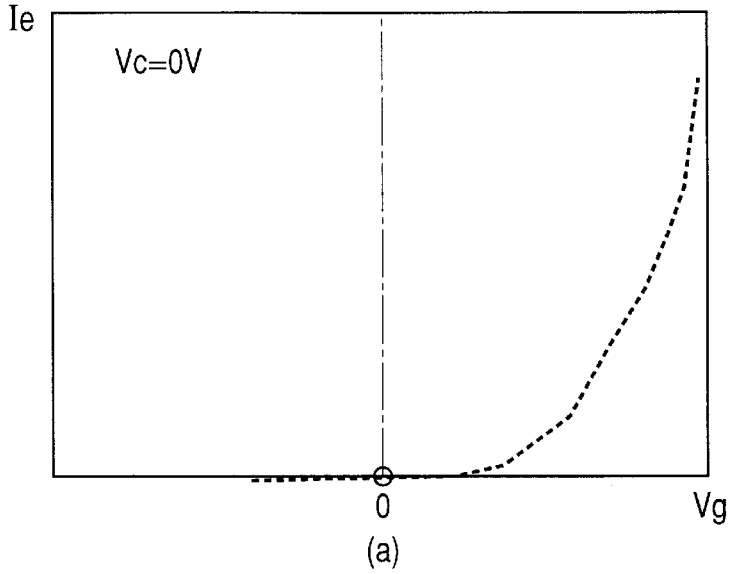
FIG. 2 is a graph showing a method of driving an electron-emitting device according to the present invention.
Figure 3:
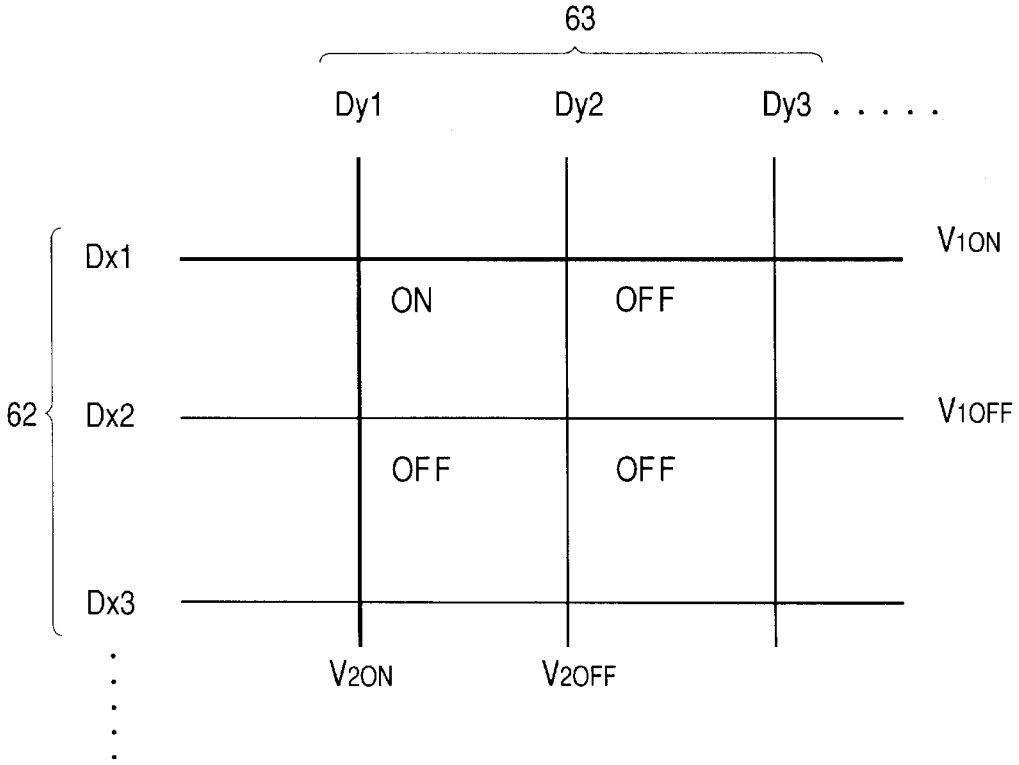
FIG. 3 is a view for explaining driving conditions for electron-emitting devices according to the present invention.

FIGS. 1A and 1B are schematic views showing an electron-emitting device as a most basic unit of an electron source to which a driving method of the present invention is applied. FIG. 1A is a sectional view of the device. FIG. 1B is a plan view of the device. FIG. 2 is a scatter diagram of a driving voltage Vg and an emission current Ie in a case (ON-OFF state) where a voltage Vc of a cathode electrode 2 of the device shown in FIGS. 1A and 1B is set to 0 V, and the electron-emitting device is driven by changing a voltage Vg of a gate electrode 4. FIG. 3 is a view for explaining conditions in which an electron source in which a plurality of electron-emitting devices, each identical to the one shown in FIGS. 1A to 2, are arranged in a matrix is driven by the driving method of the present invention.

Referring to FIGS. 1A and 1B, the electron-emitting device is comprised of a substrate 1, the cathode electrode 2, a dielectric layer 3, the gate electrode 4, and an electron-emitting layer 5. The cathode voltage Vc and gate voltage Vg are modulated and applied to the cathode electrode 2 and gate electrode 4, respectively, by a power supply 6. A cathode electrode/gate electrode voltage (Vg−Vc) is applied as a driving voltage to the electron-emitting device.

A high-voltage power supply 8 applies an anode voltage Va to an anode electrode 7. In the anode electrode 7, electrons emitted from the electron-emitting device are trapped, and an electron emission current Ie is detected.

In the electron-emitting device in FIGS. 1A and 1B, a hole having a diameter w1 and height h1 is formed. The anode electrode 7 is located above the electron-emitting device at a distance H. In general, the position of the device as a reference position for the distance H between the anode electrode and the device may be the position of the cathode electrode 2.

In a driven state, a cathode potential, gate potential, and anode potential are applied to the device, and a corresponding electric field is formed.

FIG. 2 shows the voltage-current characteristic of the above electron-emitting device. If the voltage between the gate electrode and the cathode electrode is 0 V or lower, no electron emission substantially occurs.

Figure 4:
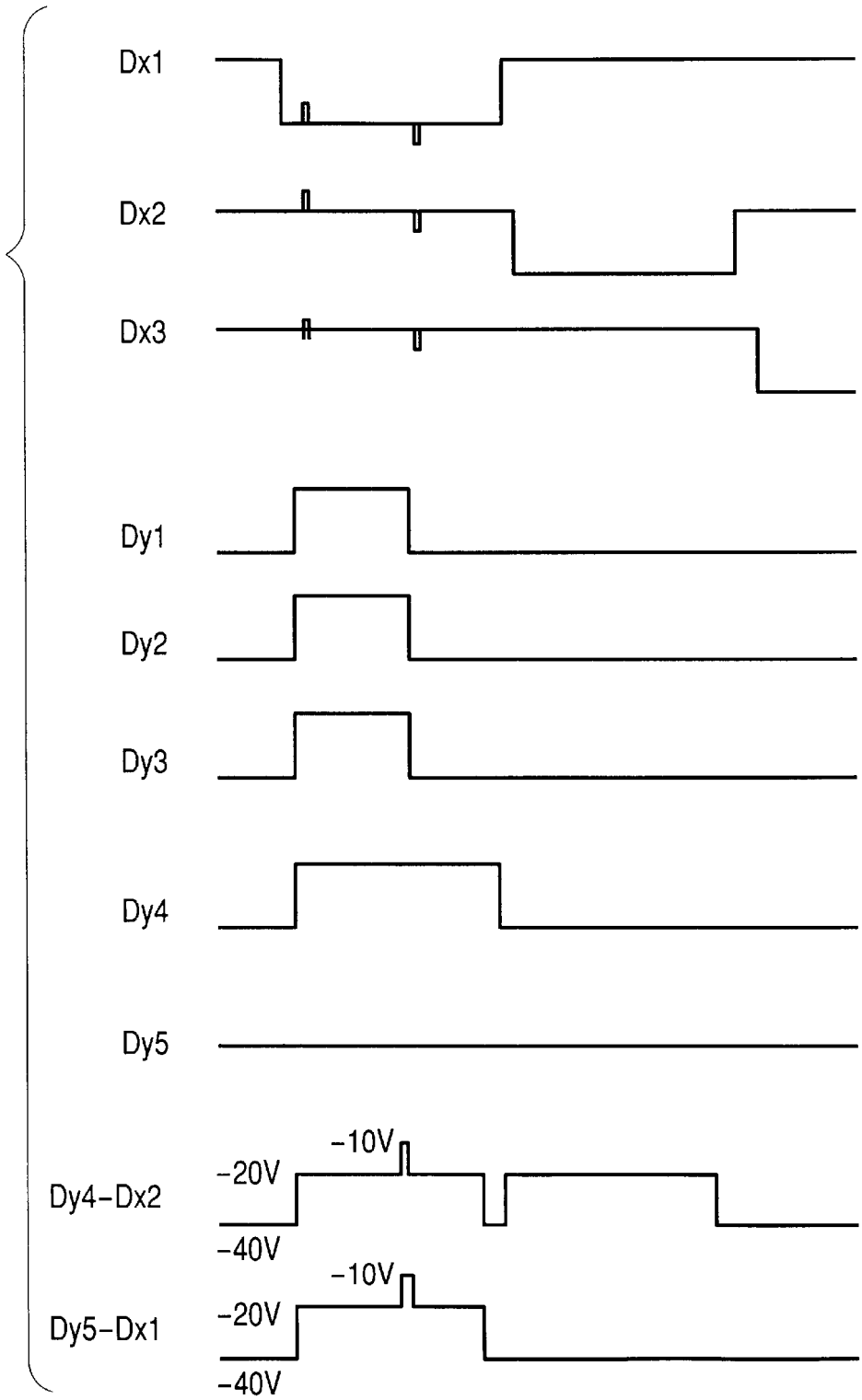
FIG. 4 is a timing chart for explaining driving conditions for electron-emitting devices according to the present invention.

FIGS. 3 and 4 are schematic views showing the method of driving an electron source according to the present invention.

FIG. 3 is a plan view showing the operation of an electron source having a matrix arrangement when it is driven. According to the driving method of the present invention, the electron-emitting device at the intersection of a scanning line Dx1 and a signal line Dy1 can be turned on. In addition, the electron-emitting device at the intersection of the scanning line Dx1 and a signal line Dy2 can be turned off, and the electron-emitting device at the intersection of a scanning line Dx2 and the signal line Dy1 can be turned off. The electron-emitting device at the intersection of the scanning line Dx2 and the signal line Dy2 can be turned off.

Figure 12:
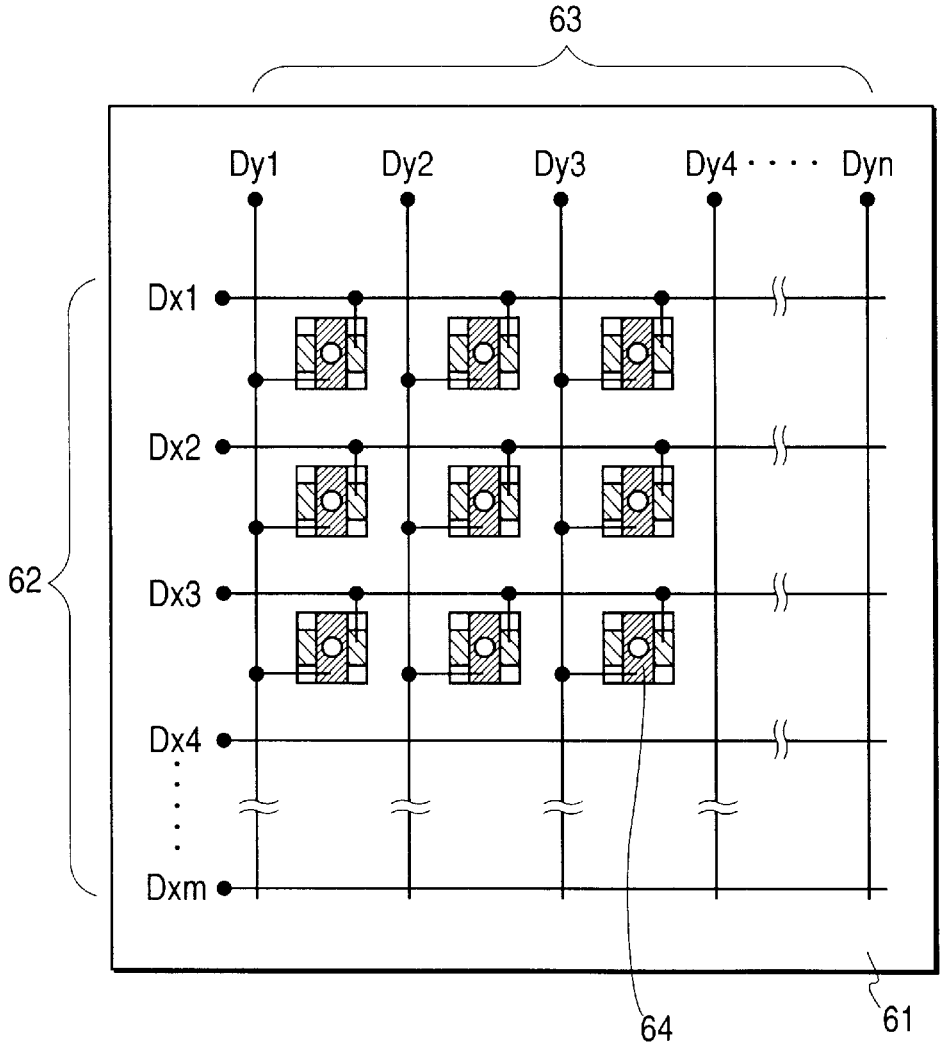
FIG. 12 is a schematic view showing an electron source having a matrix arrangement which can be applied to the present invention.

FIG. 4 shows an example of the waveform of a voltage applied to each wiring when electron-emitting devices, each identical to the one shown in FIGS. 1A and 1B, are arranged in a matrix as shown in FIG. 12, and each electron-emitting device is driven. An electron-emitting device 64 has the same structure as that shown in FIGS. 1A and 1B, in which the dielectric layer 3 is 1 $\mu$m thick. When, therefore, a voltage of 20 V is applied to the gate electrode 4, electrons are emitted. At this time, an electric field of about $2\times10^5$ V/cm is applied between the cathode electrode 2 and the gate electrode 4. Referring to FIG. 12, this structure includes scanning lines 62 including scanning lines Dx1 to Dxm to which scan signals are applied and signal lines 63 including signal lines Dy1 to Dyn to which modulated signals are applied. The scanning line 62 is connected to the cathode electrode 2 in FIGS. 1A and 1B. The signal line 63 is connected to the gate electrode 4 in FIGS. 1A and 1B. The electron-emitting devices 64 are arranged on a substrate 61.

In this case, since the cathode electrode/gate electrode voltage required for electron emission is 20 V, an ON voltage $V_{1on}$ of the selected scanning line 62 is 0 V, and an ON voltage $V_{2on}$ of the selected signal line 63 is 20 V. In addition, an OFF voltage $V_{2off}$ of each unselected signal line 63 is 0 V. An OFF voltage $V_{1off}$ of each unselected scanning line 62 is set to 40 V to enhance the OFF characteristic.

Consequently, the voltage applied between each unselected scanning line Dx2 and the signal line Dy1 to which an ON voltage is applied is −20 V. Even if a voltage drop is caused by capacitive coupling due to a change in the voltage applied to the signal line described with reference to FIG. 13, the electron-emitting device at the intersection area between the unselected scanning line Dx2 and the signal line Dy1 to which the ON voltage is applied can be controlled without being turn on even for a short period of time.

As described above, according to the driving method of the present invention, as shown in FIG. 3, since the ON voltage $V_{1on}$ applied to the selected scanning line 62 is 0 V and the OFF voltage $V_{2off}$ applied to the unselected signal line 63 is 0 V, the voltage applied to the device at the intersection of the scanning line and the signal line is 0 V. This device can therefore be turned off. On the other hand, the OFF voltage $V_{1off}$ applied to the unselected scanning line 62 is 40 V, and the OFF voltage $V_{2off}$ applied to the unselected signal line 63 is 0 V. Consequently, the voltage applied to the device at the intersection of the scanning line and the signal line is −40 V. This device can therefore be turned off completely without any problem in terms of a rise in applied voltage due to the above capacitance. That is, according to the driving method of the present invention, letting $V_{1on}$, be the ON voltage applied to the selected scanning line 62, $V_{1off}$ be the OFF voltage applied to the unselected scanning line 62, $V_{2on}$ be the ON voltage applied to the selected signal line 63, and $V_{2off}$ be the OFF voltage applied to the unselected signal line 63, at least $V_{1off}>V_{2on}>V_{1on}$ is satisfied, and more preferably, $V_{2on}>V_{2off}$ is satisfied. More preferably, $V_{1off}>V_{2on}>V_{1on}>V_{2off}$ is satisfied.

An actual numerical example has been described above. A general numerical example will be described below.

Letting X be the number of scanning lines (first-directional wirings) 62, Y be the number of signal lines (second-directional wirings) 63, $V_{1on}$ be the ON voltage of each scanning line, $V_{1off}$ be the OFF voltage of each scanning line, $V_{2on}$ be the ON voltage of each signal line, $V_{2off}$ be the OFF voltage of each signal line, Cd be the capacitance at the intersection of each signal line and each scanning line, Cpx be the parasitic capacitance of each scanning line, and Cpy be the parasitic capacitance of each signal line, each scanning line undergoes the following voltage drop due to instantaneous capacitive coupling when all the signals change from the ON state to the OFF state:

$$\delta V=(V_{2on}-V_{2off})\times(Y\times Cd)/(Cpx+Y\times Cd)$$

Letting Vth be a threshold voltage, therefore, the voltage $(V_{2on}-V_{1off}+\delta V)$ applied to the device at the intersection of the selected signal line and the unselected signal line must be lower than Vth.

Obviously, this condition depends on Cpx, Cd, and Y and the voltage applied to each wiring. If $Cpx<<Y\times Cd$, since $(Y\times Cd)/(Cpx+Y\times Cd)\sim1$, $\delta V\sim V_{2on}-V_{2off}$.

The voltage applied to the device is therefore given by $2V_{2on}-V_{1off}-V_{2off}$. Even if the threshold Vth for the electron emission of the electron-emitting device is 0 V, the voltage applied to the device does not become Vth or higher in any condition as long as $V_{1off}$ is higher than the voltage $2V_{2on}-V_{2off}$ in the ON state.

From the viewpoint of design, as $V_{1off}$ increases, the effect against a voltage drop due to a signal line is enhanced. It is, however, not preferable that the power supply be excessively increased by increasing $V_{1off}$. For this reason, an optimal value is preferably set according to the above relationship.

Figure 13:
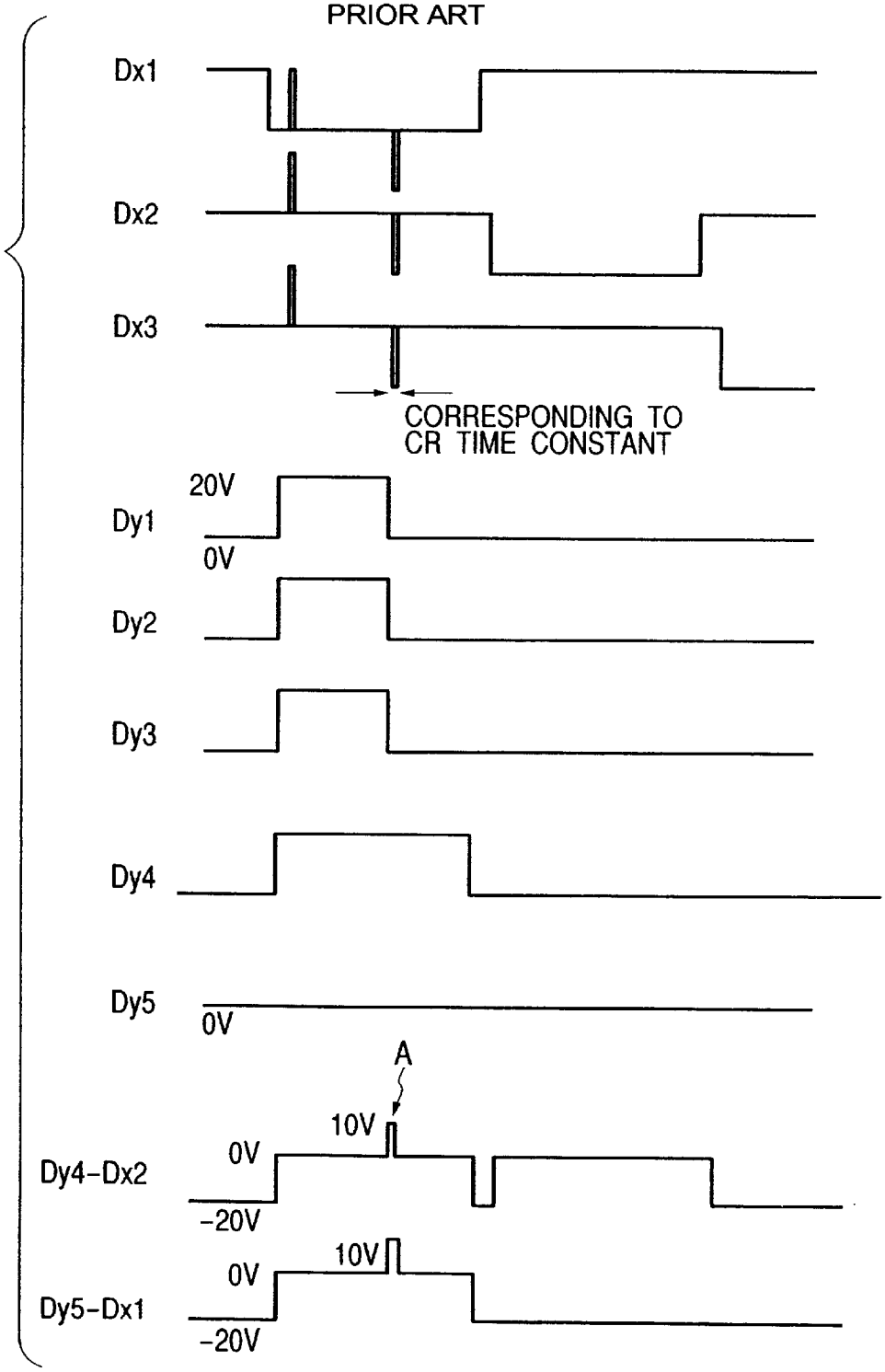
FIG. 13 PRIOR ART
FIG. 13 is a timing chart schematically showing an example of a conventional method of driving an image-forming apparatus.
Figure 14:
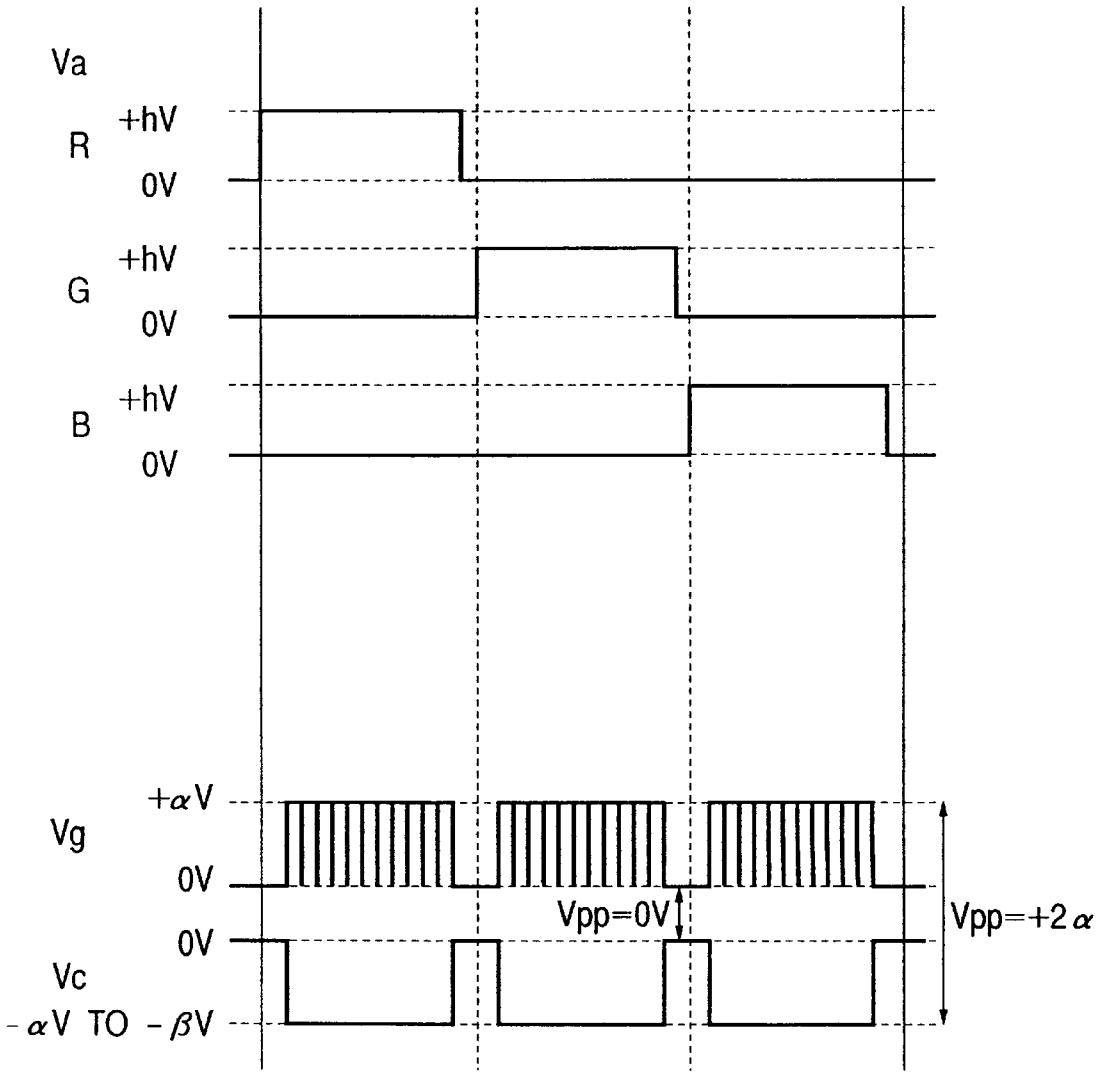
FIG. 14 PRIOR ART
FIG. 14 is a timing chart schematically showing the conventional method of driving the image-forming apparatus.

In addition, the condition of the device at the intersection of Dx1 and Dy5 described with reference to FIG. 13 is not preferable. This device should be turned off. Even if, however, the device is not turned off but emits light, since this light emission continues for only a period of time corresponding to a CR time constant which is taken to restore the normal state, a deterioration in image quality below several grayscale levels can be suppressed although it depends on the design of wirings and the like. If possible, $V_{2off}$ is preferably decreased to make $V_{1on}-V_{2off}$ become a positive value. However, the driving voltage rises to increase the power consumption. From this point of view, therefore, the above value should not be increased much. Since the power consumption is determined by a mathematical expression expressed by $CfV^2$, the power consumed by a signal line with a large value of f becomes higher than the power consumed by charging/discharging of the capacitance of a scanning line. It is therefore not preferable that the driving voltage for each signal line be excessively increased. With regard to the scanning lines, the value of f is small, and the problem of power consumption is not a dominant problem. In addition, the problem of image quality is serious, as described above. For these reasons, the driving method with increased $V_{1off}$ is a very effective driving method.

In the above case, the cathode electrode 2 is connected to the scanning line 62, and the gate electrode 4 is connected to the signal line (modulated signal wiring) 63. The present invention is not, however, limited to this arrangement, and can be equally applied to an arrangement in which the gate electrode 4 is connected to the scanning line 62, and the cathode electrode 2 is connected to the signal line 63. It should be noted that in this case, the relationship between the voltages applied to the scanning wiring and the signal wiring described above is reversed.

This relationship will be described with reference to the arrangement shown in FIG. 3. The ON voltage $V_{1on}$ applied to the selected scanning line Dx1 is 20 V, the OFF voltage $V_{1off}$ applied to the unselected scanning line Dx2 is −20 V, the ON voltage $V_{2on}$, applied to the selected signal line Dy1 is 0 V, and the OFF voltage $V_{2off}$ applied to the unselected signal line Dy2 is 20 V.

That is, in the driving method of the present invention for a case where the gate electrode 4 is connected to the scanning line 62, and the cathode electrode 2 is connected to the signal line 63, at least $V_{1off}<V_{2on}<V_{1on}$, is satisfied, and $V_{2on}<V_{2off}$ is also satisfied. In addition, $V_{1off}<V_{2on}<V_{1on}<V_{2off}$ is preferably satisfied.

In addition, in this case, when all the signal lines change from the ON state to the OFF state, each scanning line undergoes the following voltage rise due to instantaneous capacitive coupling:

$$\delta V=(V_{2off}-V_{2on})\times(Y\times Cd)/(Cpx+Y\times Cd)$$

Therefore, while the device at the intersection of the signal line selected with the threshold voltage Vth and another scanning line is in the OFF state, Vth>(the voltage applied to the device=$V_{1off}-V_{2on}+\delta V$) is required.

Obviously, this condition depends on the voltages of Cpx, Cd, and Y. If Cpx<<Y×Cd, since (Y×Cd)/(Cpx+Y×Cd)~1, $\delta V\sim V_{2off}-V_{2on}$. As a consequence, voltage=$V_{off}+V_{2off}-2V_{2on}$ is applied to the device. Even if the threshold Vth for the emission of electrons from the electron-emitting device is 0 V, the voltage applied to the device does not become equal to or higher than Vth in any state as long as $V_{1off}$ is lower than the voltage $V_{2off}-2V_{2on}$ in the ON state.

In the present invention, the "electron source" is comprised of the plurality of row-directional wirings (to be also referred to as "X-directional wirings" or "first-directional wirings" in some cases) 62, the plurality of column-directional wirings (to be also referred to as "Y-directional wirings" or "second-directional wirings" in some cases) 63, and the plurality of electron-emitting devices 64. Each electron-emitting device is connected to one of the plurality of row-directional wirings 62 and one of the plurality of column-directional wirings 63. In addition, the "matrix arrangement" in the present invention indicates an arrangement in which the above row-directional wirings 62 and the column-directional wirings 63 cross each other. Obviously, the row-directional wirings 62 and the column-directional wirings 63 are kept electrically insulated from each other at the intersections of the row-directional wirings 62 and the column-directional wirings 63.

In an electron-emitting device like the one shown in FIGS. 1A and 1B to which the present invention is applied, since a flat equipotential surface without distortion is formed between the electron-emitting layer 5 and the anode electrode 7, an electron beam does not diverge much. That is, the electron beam diameter can be reduced.

Furthermore, a device according to the present invention has a very simple structure formed by repeatedly stacking layers, and can be manufactured in a simple manufacturing process with a high yield.

FIGS. 5A to 5F shows a general method of manufacturing this device.

An example of the method of manufacturing an electron-emitting device as a component of an electron source to which the present invention is applied will be described below with reference to FIGS. 5A to 5F.

Figure 5A:
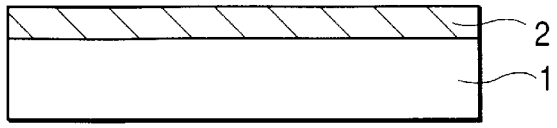
FIGS. 5A, 5B, 5C, 5D, 5E and 5F are sectional views showing an example of a method of manufacturing an electron-emitting device which can be applied to the present invention.

As shown in FIG. 5A, the cathode electrode 2 is disposed on the substrate 1 whose surface is sufficiently cleaned. A multilayer member formed by stacking an $SiO_2$ layer on a silicon substrate, glass in which the content of an impurity such as Na is reduced, soda lime glass, quartz or an insulating substrate made of a ceramic material such as alumina may be used as the substrate 1.

The cathode electrode 2 has electroconductivity and is formed by vapor deposition, a general vacuum film forming technique such as sputtering, or photolithography. A material for the cathode electrode 2 is properly selected from, for example, metals such as Be, Mg, Ti, Zr, Hf, V, Nb, Ta, Mo, W, Al, Cu, Ni, Cr, Au, Pt, and Pd, alloy materials thereof, carbides such as TiC, ZrC, HfC, TaC, SiC, and WC, borides such as $HfB_2$, $ZrB_2$, $LaB_6$, $CeB_6$, $YB_4$, and $GdB_4$, nitrides such as TiN, ZrN, and HfN, semiconductors such as Si and Ge, organic polymeric materials, amorphous carbon, graphite, diamond-like carbon, and diamond-dispersed carbon, diamond-dispersed carbon compounds, and the like. The thickness of the cathode electrode 2 is set within the range of several ten nm to several mm, and preferably in the range of several hundred nm to several $\mu$m.

Figure 5B:
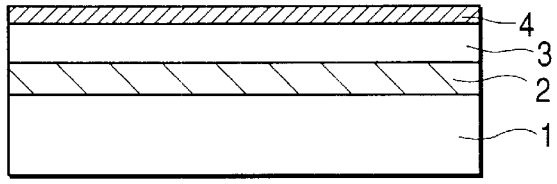

As shown in FIG. 5B, the dielectric layer 3 is then deposited on the cathode electrode 2. The dielectric layer 3 is formed by a general vacuum deposition method such as sputtering, CVD, or vacuum evaporation. The thickness of the dielectric layer 3 is set within the range of several nm to several $\mu$m, and preferably the range of several ten nm to several hundred nm. As a material for the dielectric layer 3, a material having a breakdown voltage high enough to stand a high electric field, e.g., $SiO_2$, SiN, $Al_2O_3$, or CaF is preferably used.

The gate electrode 4 is deposited on the dielectric layer 3. The gate electrode 4 has electroconductivity like the cathode electrode 2 and is formed by a general vacuum deposition technique such as deposition or sputtering, or photolithography. A material for the gate electrode 4 is properly selected from, for example, metals such as Be, Mg, Ti, Zr, Hf, V, Nb, Ta, Mo, W, Al, Cu, Ni, Cr, Au, Pt, and Pd, alloy materials thereof, carbides such as TiC, ZrC, HfC, TaC, SiC, and WC, borides such as $HfB_2$, $ZrB_2$, $LaB_6$, $CeB_6$, $YB_4$, and $GdB_4$, nitrides such as TiN, ZrN, and HfN, semiconductors such as Si and Ge, organic polymeric materials, and the like. The thickness of the gate electrode 4 is set within the range of several nm to several ten $\mu$m, and preferably in the range of several nm to several hundred nm.

Note that the electrodes 2 and 4 may be made of the same material or different materials by the same forming method or different methods.

Figure 5C:
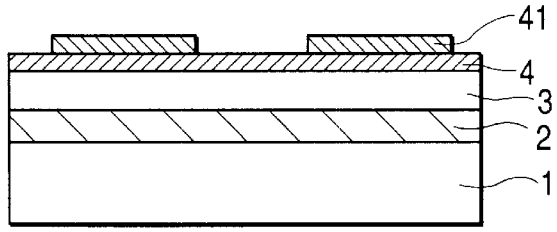

As shown in FIG. 5C, the a mask pattern 41 is formed by photolithography.

Figure 5D:
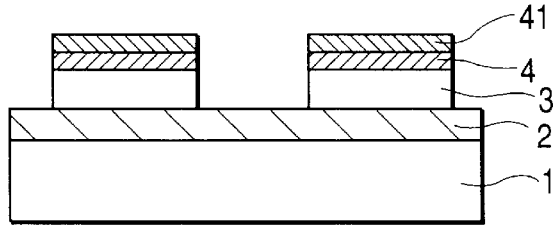

As shown in FIG. 5D, a multilayer structure in which parts of the layers 3 and 4 are omitted is formed. However, this etching step may be stopped on the cathode electrode 2 or part of the cathode electrode 2 may be etched.

In the etching step, etching methods may be selected in accordance with the materials for the layers 3 and 4 and the mask pattern 41.

Figure 5E:
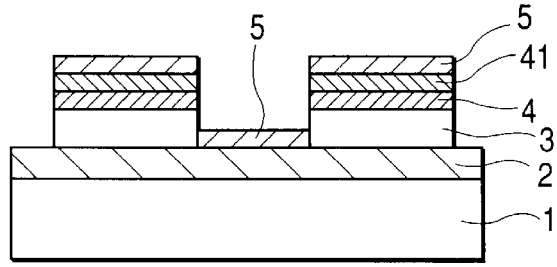

As shown in FIG. 5E, the electron-emitting layer 5 is deposited on the entire surface of the resultant structure. The electron-emitting layer 5 is formed by a general film forming technique such as sputtering or plasma CVD. As a material for the electron-emitting layer 5, a material having a low work function is preferably selected. For example, such a material is selected from amorphous carbon, graphite, diamond-like carbon, diamond-dispersed carbon, diamond-dispersed carbon compounds, and the like, preferably a thin diamond film with a low work function, diamond-like carbon, and the like. The thickness of the electron-emitting layer 5 is set within the range of several nm to several hundred nm, and preferably in the range of several nm to several ten nm.

Figure 5F:
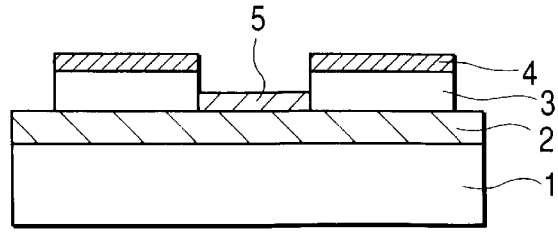

As shown in FIG. 5F, the mask pattern 41 is removed to complete a device like the one shown in FIGS. 1A and 1B.

The diameter w1 of the hole is a factor that greatly depends on the electron emission characteristics of the device and properly set in accordance with the characteristics of a material for the device, especially the work function and thickness of the electron-emitting layer, a driving voltage for the device, and the required shape of an electron beam. In general, w1 is set within the range of several hundred nm to several ten $\mu$m.

The hole is not limited to any specific shape and may have a rectangular shape.

The height h1 of the hole is another factor that depends on the electron emission characteristics of the device and properly set in accordance with the thicknesses of the dielectric layer and electron-emitting layer to apply an electric field required for electron emission. In addition, the height h1 of the hole is associated with the shape of an electron beam. The height hi of the hole is a parameter that determines the capacitance formed by each scanning line and signal line in matrix wiring. This value should be designed in consideration of matching with other parameters.

In some case, after the cathode electrode 2 is patterned, the electron-emitting layer 5 is formed on the entire surface of the resultant structure, and etching is stopped on the upper surface of the electron-emitting layer 5 in the etching step. In addition, a thin diamond film, diamond-like carbon, or the like may be selectively deposited on a desired portion.

Furthermore, instead of the hole structure, a convex structure that is the reverse of the hole structure may be formed.

An application example of an electron-emitting device as a component of an electron source to which the present invention can be applied will be described below. An image-forming apparatus can be formed by arranging a plurality of electron-emitting devices of the present invention on a base member.

Various arrangements of a plurality of electron-emitting devices constituting an electron source are adopted. For example, an image-forming apparatus can be formed by using matrix driving described above.

Figure 6:
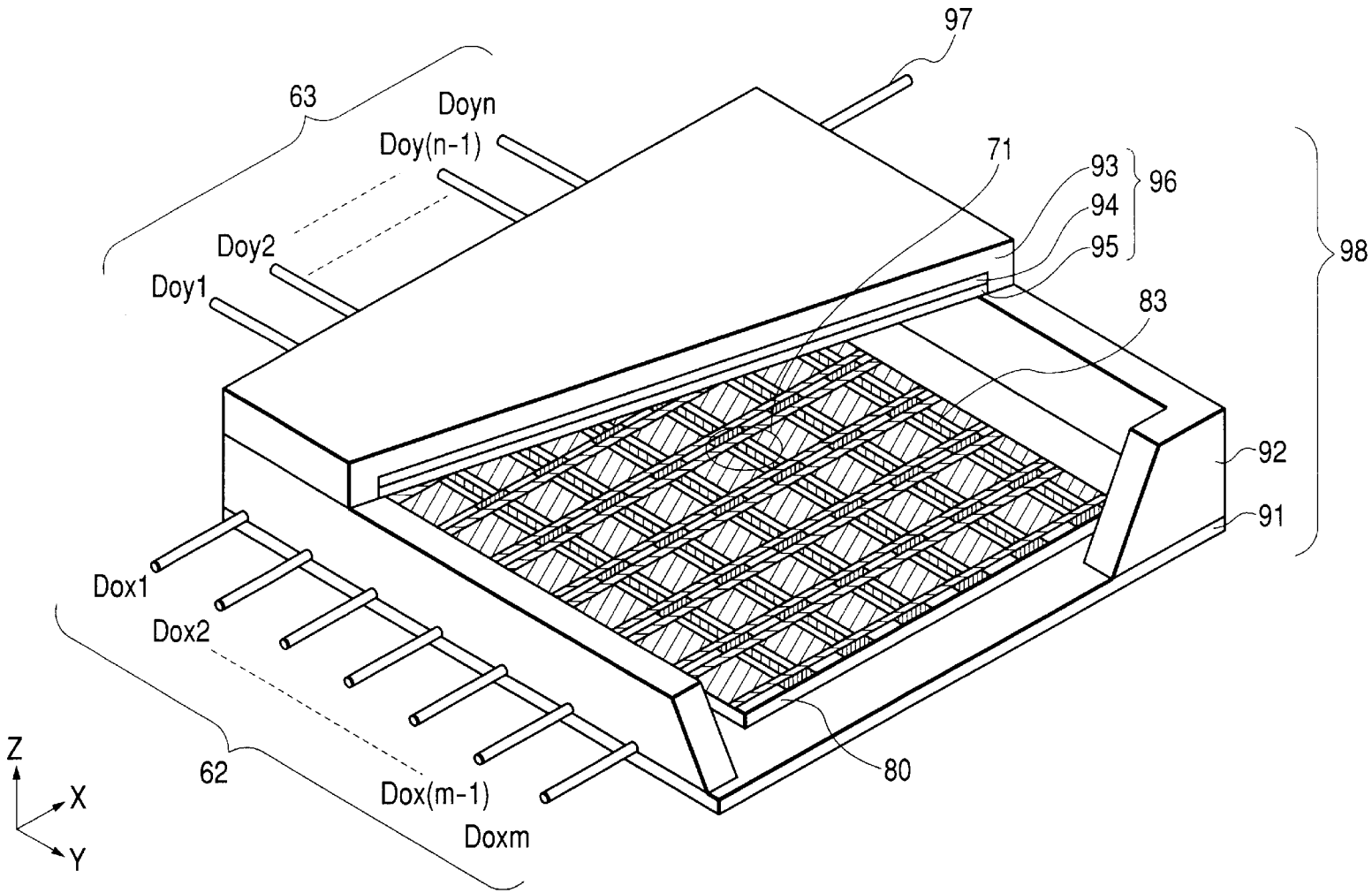
FIG. 6 is a schematic view showing an image-forming apparatus using an electron source having a matrix arrangement which can be applied to the present invention.

In the above arrangement, each device can be selected and independently driven by using matrix wiring. An image-forming apparatus using an electron source with such a matrix arrangement will be described with reference to FIG. 6. FIG. 6 is a schematic view showing an example of the display panel of the image-forming apparatus.

Referring to FIG. 6, this display panel includes electron-emitting devices 71, an electron source substrate 80 on which a plurality of electron-emitting devices are arranged, a rear plate (first substrate) 91 to which the electron source substrate 80 is fixed, a face plate (second substrate) 96 having a phosphor film 94, metal back 95, and the like formed in the inner surface of a glass substrate 93, and a support frame 92 to which the rear plate 91 and face plate 96 are bonded by using fist glass or the like.

As described above, an envelope (panel) 98 is comprised of the face plate 96, support frame 92, and rear plate 91. The rear plate 91 is mainly provided to reinforce the substrate 80. If the substrate 80 itself has sufficient strength, the rear plate 91 as a discrete member can be omitted, and the substrate 80 and rear plate 91 may be an integral member.

The bonding surfaces of the face plate 96 having the phosphor film 94 and metal back 95 arranged in its inner surface, the rear plate 91, and the support frame 92 are coated with fist glass, and the face plate 96, support frame 92, and rear plate 91 are aligned to each other at predetermined positions, fixed, heated, and baked to be seal-bonded.

As a heating means for baking and seal-bonding, a lamp heating means using an infrared lamp or the like, a hot plate, or the like can be used. However, this heating means is not limited to them. An adhesive material used when a plurality of members constituting an envelope are heated/seal-bonded is not limited to fist glass. Various adhesive materials can be used as long as they can form a satisfactory vacuum atmosphere after the seal-bonding step.

The above envelope is an embodiment of the present invention and is not limited to this. Various types of envelopes can be used.

Another example of the envelope 98 may be comprised of the face plate 96, support frame 92, and substrate 80 with the support frame 92 being directly seal-bonded to the electron source substrate 80. Alternatively, the envelope 98 having sufficient strength against atmospheric pressure can be formed by inserting a support member (not shown) called a spacer between the face plate 96 and the rear plate 91.

Figure 7A:
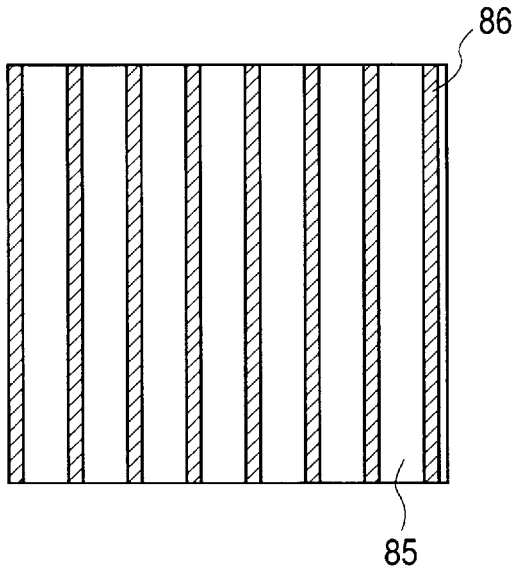
FIGS. 7A and 7B are views each showing a phosphor film in an image-forming apparatus which can be applied to the present invention.
Figure 7B:
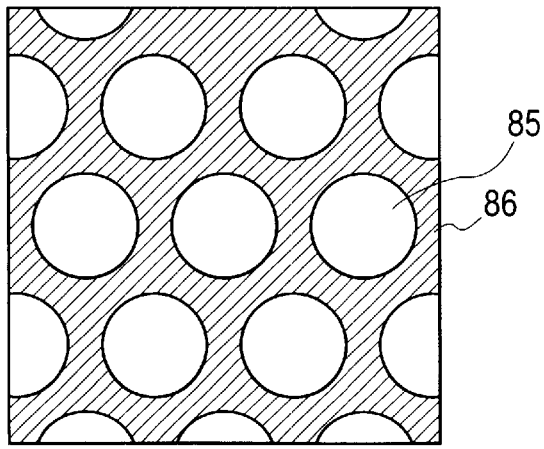

FIGS. 7A and 7B are schematic views showing the phosphor film 94 formed on the face plate 96. The phosphor film 94 can be made of only a phosphor 85 when the film is monochromatic. A color phosphor film is made up of phosphors 85 and a black electroconductive material called a black stripe or black matrix.

The purposes of using a black stripe (or black matrix) are to make color mixture and the like inconspicuous by making the differently colored portions between the phosphors 85 of three primary colors black when color display is to be performed and to suppress a decrease in contrast due to external light reflection by the phosphor film 94. As a material for the black stripe, a material having electroconductivity and exhibiting little transmission and reflection of light can be used as well as a generally used material containing graphite as a main component.

As a method of coating the glass substrate 93 with a phosphor, a deposition method, a printing method, or the like can be used regardless of whether a monochrome or color panel is to be formed. In general, the metal back 95 is formed on the inner surface of the phosphor film 94. The purposes of forming the metal back are to increase luminance by specularly reflecting, toward the face plate 96 side, light of the light emitted from the phosphor which propagates to the inner surface side, to serve as an electrode for applying an electron beam accelerating voltage, and to protect the phosphor film 94 from damage due to the collision of negative ions produced inside the envelope. The metal back 95 can be manufactured by smoothening (generally called "filming") the inner surface of a manufactured phosphor film and depositing Al on the surface by vacuum evaporation or the like.

The face plate 96 may also have a transparent electrode (not shown) on the outer surface side of the phosphor film 94 to improve the electroconductivity of the phosphor film 94.

According to the present invention, the phosphor film 94 is positioned to be located immediately above the electron-emitting device 71 to let an electron beam reach a portion immediately above the electron-emitting device 71.

The "vacuum sealing step" of sealing the envelope (panel) having undergone the seal bonding step while the interior of the envelope is held in a depressurized condition will be described next.

In the vacuum sealing step, while the envelope (panel) 98 is heated and kept at 80 to 250° C., the envelope is evacuated by an evacuation unit such as an ion pump or sorption pump through an exhaust pipe (not shown) to form an atmosphere in which organic materials are sufficiently reduced. Thereafter, the exhaust pipe is heated and melted by using a burner to be sealed and cut. Getter processing may also be performed to maintain the pressure in the envelope 98 after sealing. In this processing, immediately before or after the envelope 98 is sealed, a getter placed at a predetermined position (not shown) in the envelope 98 is heated by resistance heating, high-frequency heating, or the like to form an evaporation film. The getter generally contains Ba as a main component and is used to maintain an atmosphere in the envelope 98 by the adsorption effect of the evaporation film.

In an image-forming apparatus formed by using an electron source having a matrix arrangement which is manufactured in the following steps, as shown in FIG. 6, voltages are applied to the respective electron-emitting devices through the terminals Dox1 to Doxm and Doy1 to Doyn outside the envelope to cause electron emission. The high voltage Va is applied to the metal back 95 or transparent electrode (not shown) through a high-voltage terminal 97 to accelerate an electron beam.

The accelerated electrons impinge on the phosphor film 94 to emit light, thereby forming an image.

Figure 8:
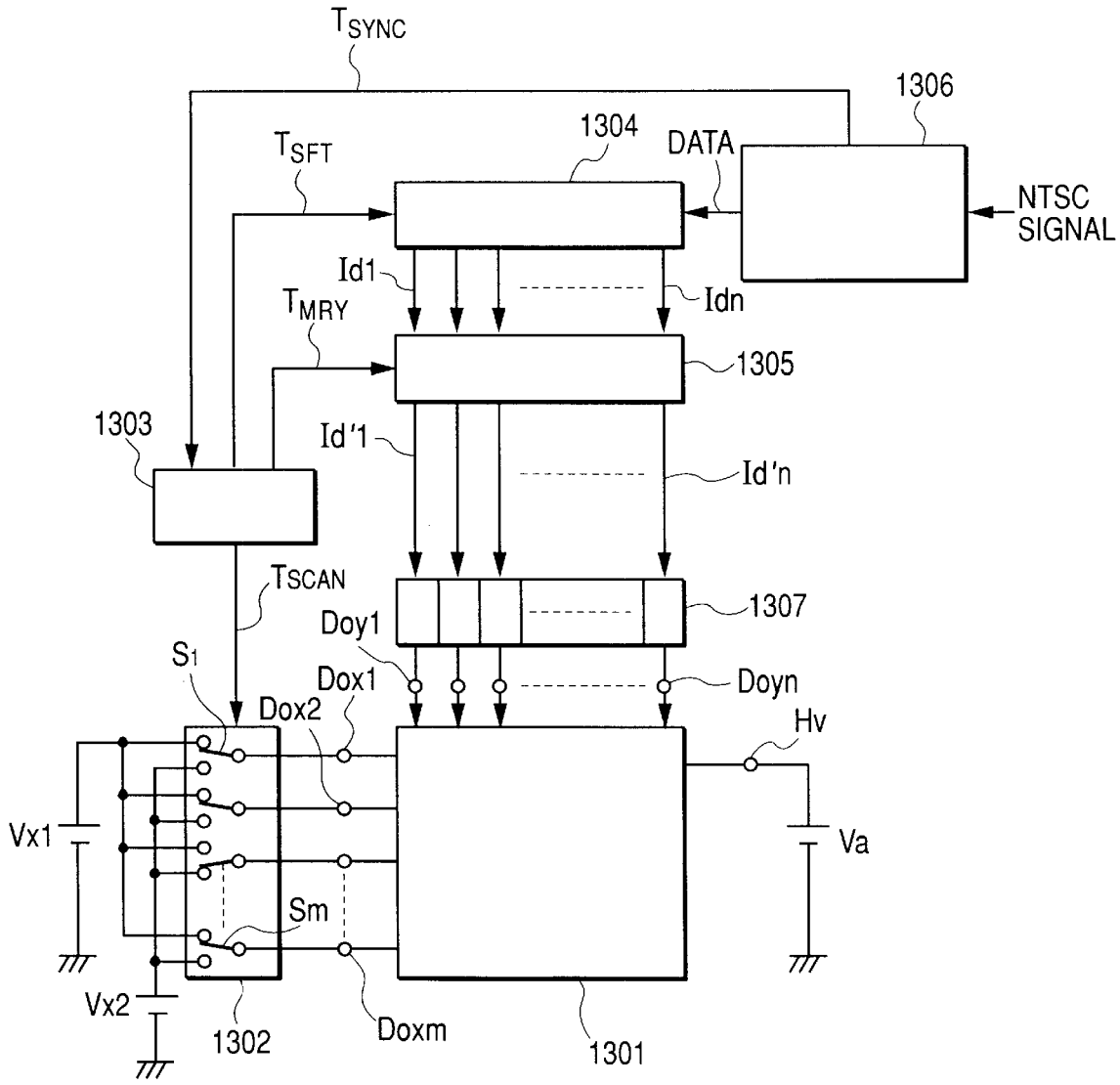
FIG. 8 is a block diagram showing the overall arrangement of the image-forming apparatus according to the present invention.

FIG. 8 is a block diagram showing an example of a driving circuit for an electron source which is used to display an image according to an NTSC TV signal.

The scanning circuit shown in FIG. 8 will be described. This circuit has m switching elements (schematically shown as elements S1 to Sm in FIG. 8). Each switching element selects an output voltage from a DC voltage source Vx1 or a power supply Vx2 and is electrically connected to a corresponding one of terminals Dox1 to Doxm of a display panel 1301. Each of the switching elements S1 to Sm operates on the basis of a control signal Tscan output from a control circuit 1303 and can be formed in combination of switching elements such as FETs.

In this case, the DC voltage sources Vx1 and Vx2 are set on the basis of the characteristics of the above electron-emitting device which can be applied to the present invention.

The control circuit 1303 has the function of matching the operations of the respective portions to properly display an image on the basis of an externally input image signal. The control circuit 1303 generates the control signal Tscan and control signals Tsft and Tmry for the respective portions on the basis of a sync signal Tsync sent from a sync signal separating circuit 1306.

The sync signal separating circuit 1306 is a circuit for separating a sync signal component and luminance signal component from an externally input NTSC TV signal and can be formed by using a general frequency separating (filter) circuit and the like. The sync signal separated by the sync signal separating circuit 1306 is constituted by vertical and horizontal sync signals, which are shown as the signal Tsync for the sake of descriptive convenience. The luminance signal component of the image which is separated from the TV signal is shown as a signal DATA for the sake of convenience. The signal DATA is input to a shift register 1304.

The shift register 1304 serial/parallel-converts the signal DATA input as time-series data for each line of an image, and operates on the basis of the control signal .Tsft sent from the control circuit 1303 (i.e., the control signal Tsft can be regarded as a shift clock for the shift register 1304). The data of one line of the image having undergone serial/parallel conversion is output as parallel signals ld1 to ldn from the shift register 1304.

A line memory 1305 is a storage unit for storing 1-line data of an image for a necessary period of time, and stores the contents of the signals ld1 to ldn in accordance with the control signal Tmry sent from the control circuit 1303, as needed. The stored contents are output as image data ld1 to ldn to a modulated signal generator 1307.

The modulated signal generator 1307 is a signal source for properly driving/modulating the respective electron-emitting devices of the present invention in accordance with the image data ld1 to ldn. Output signals from the modulated signal generator 1307 are applied to the electron-emitting devices of the present invention in the display panel 1301 through terminals Doy1 to Doyn. When a pulse-like voltage is to be applied to this device, for example, no electron emission occurs upon application of a voltage lower than an electron emission threshold, but an electron beam is output upon application of a voltage equal to or higher than the electron emission threshold. In this case, the intensity of an output electron beam can be controlled by changing a peak value Vm of a pulse. In addition, the total amount of charge of an output electron beam can be controlled by changing a width Pw of a pulse.

As a scheme of modulating each electron-emitting device in accordance with an input signal, therefore, a voltage modulation scheme, pulse width modulation scheme, or the like can be used. In executing a voltage modulation scheme, a circuit based on the voltage modulation scheme of generating a voltage pulse with a predetermined length and properly modulating the peak value of a pulse in accordance with input data can be used as the modulated signal generator 1307.

In executing a pulse width modulation scheme, a circuit based on the pulse width modulation scheme of generating a voltage pulse with a predetermined peak value and properly modulating the width of a voltage pulse in accordance with input data can be used.

As the shift register 1304 and line memory 1305, a register and memory based on the digital signal scheme or analog signal scheme can be used as long as serial/parallel conversion and storage of image signals are performed at predetermined rates.

When the digital signal scheme is to be used, the output signal DATA from the sync signal separating circuit 1306 must be converted into a digital signal. For this operation, an A/D converter is connected to the output section of the sync signal separating circuit 1306. A circuit used for the modulated signal generator 1307 slightly differs depending on whether an output signal from the line memory 1305 is a digital or analog signal. In the case of the voltage modulation scheme using digital signals, a D/A conversion circuit is used as the modulated signal generator 1307, and an amplification circuit is added as needed. In the case of the pulse width modulation scheme, a circuit obtained by combining, for example, a high-speed oscillator, a counter for counting the wave number of a signal output from the oscillator, and a comparator for comparing an output value from the counter with an output value from the memory is used. An amplifier may be added to this circuit, as needed, to amplify a pulse-width-modulated signal output from the comparator to a driving voltage for the electron-emitting device of the present invention.

In the case of the voltage modulation scheme using analog signals, for example, an amplification circuit using an operational amplifier may be used for the modulated signal generator 1307, and a level shift circuit may be added to this circuit as needed. In the case of the pulse width modulation scheme, for example, a voltage-controlled oscillator (VCO) can be used, and an amplifier for amplifying an output signal to a driving voltage for the electron-emitting device of the present invention can be added to this circuit as needed.

The above arrangement of the image-forming apparatus is an example of the image-forming apparatus to which the present invention can be applied, and various modifications of the arrangement can be made on the basis of the technical idea of the present invention. Although an NTSC signal has been presented as an input signal, the input signal is not limited to this scheme. For example, the PAL or SECAM scheme or a scheme using a TV signal scheme constituted by many scanning lines (e.g., a high-definition TV scheme such as the MUSE scheme) can be used.

This apparatus can be used as an image-forming apparatus serving as a printer using a photosensitive drum and the like as well as a display apparatus.

Examples of the present invention will be described in detail below.

EXAMPLE 1

FIGS. 1A and 1B are a plan view and sectional view of an electron-emitting device manufactured according to this example. FIGS. 5A to 5F are sectional views showing an example of a method of manufacturing the electron-emitting device according to the example. A manufacturing process for the electron-emitting device according to the example will be described in detail below.

(Step 1)

As shown in FIG. 5A, quartz was used for a substrate 1, and the substrate was sufficiently cleaned. Thereafter, a Ta film having a thickness of 300 nm was formed as a cathode electrode 2 by sputtering.

(Step 2)

As shown in FIG. 5B, a 600-nm thick $SiO_2$ film and 100-nm thick Ta film were sequentially deposited as a dielectric layer 3 and gate electrode 4 in the order named.

(Step 3)

As shown in FIG. 5C, a mask pattern 41 was formed by spin-coating a positive photoresist (AZ1500 available from Clarian) and exposing and developing a photomask.

(Step 4)

As shown in FIG. 5D, the gate electrode 4 made of Ta and the dielectric layer 3 were dry-etched by using the mask pattern 41 as a mask and $CF_4$ gas, and the dry etching is stopped at the cathode electrode 2, thereby forming a circular hole having a diameter w1 of 3 $\mu$m.

(Step 5)

As shown in FIG. 5E, an electron-emitting layer 5 made of diamond-like carbon was deposited on the entire surface to a thickness of about 100 nm by plasma CVD. As a reaction gas, $CH_4$ gas was used.

(Step 6)

As shown in FIG. 5F, the mask pattern 41 was completely removed to complete the electron-emitting device of this example. A height h1 of the hole was 500 nm.

The electron-emitting device manufactured in the above manner was driven by the method shown in FIG. 3 with H=2 mm as shown in FIGS. 1A and 1B. Va=10 kV, $V_{1on}$=0 V, $V_{1off}$=40 V, $V_{2on}$=20 V, and $V_{2off}$=0 V. As Comparative Example 1, consider a case where $V_{1off}$=20 V. A scanning line 62 and signal line 63 each had a capacitance of 10 pF, and the number of scanning lines 62 and signal lines 63 required to form QVGA pixels are 240×320 (960 RGB pixels). The total capacitance of the scanning lines 62 is about ½ that of the signal lines 63 and scanning lines 62. When the potential of all the signal lines 63 changed by 20 V, the voltage of each scanning line 62 dropped by 10 V. In this example, even if the potential of the scanning line 62 dropped by 10 V, since $V_{1off}$=40 V, the potential of each scanning line 62 became only 30 V, and the potential of the electron-emitting device became −10 V and hence was kept. OFF.

In this case, an electrode coated with a phosphor was used as an anode, and the size of an electron beam was observed. In this case, the size of an electron beam was the size of an electron beam up to a region where the intensity was 10% of the peak luminance of the phosphor that emitted light. As a result, electron beams in the ON state in both the cases were equal-to each other, i.e., 150 $\mu$m.

In the comparative example, when the potential of the scanning line 62 dropped by 10 V due to the signal line 63, a voltage of 10 V was applied to the electron-emitting device. Consequently, light emission was confirmed and a great deterioration in image quality was observed. In contrast to this, when the device was driven by the driving method according to this example, an electron emission current Ie in the OFF state became 1/100 or less of that in the ON state, and hence no light emission from the phosphor was observed.

EXAMPLE 2

A driving method according to this example will be described below.

Unlike Example 1, $V_{2off}$ was set to −4 V. In this case, since the voltage of a scanning line Dx1 dropped by $V_{2on}-V_{2off}$=24 V, the potential drop due to capacitive coupling was about ½, i.e., about 12 V, at maximum. As a consequence, a voltage of about (−4 V) (−12 V), i.e., 8 V, was applied to each pixel in the OFF state within Dx1. As compared with 10 V in the prior art, the current was reduced by two orders of magnitude, resulting in a great improvement in image quality. However, the power consumption increased 1.5 times. This is because the driving voltage for the signal line rose from 20 V to 24 V. This method is especially effective for a case where a high priority is given to image quality, and an increase in power consumption is allowed.

EXAMPLE 3

A driving method according to this example will be described.

Unlike Example 1, diodes were connected to scanning wirings at positions around the matrix to prevent the voltage from dropping to 0 V or lower for a long period of time. $V_{2off}$ was set to 0 V. In this case, since the voltage drop at a scanning line Dx1 was $V_{2on}-V_{2off}$, i.e., 20 V, the potential drop due to capacitive coupling was about ½ the above voltage drop, i.e., 10 V. However, since a diode is connected to the scanning line, the potential settled down at 0 V in a relatively early stage, thus greatly improving image quality.

EXAMPLE 4

Figure 9:
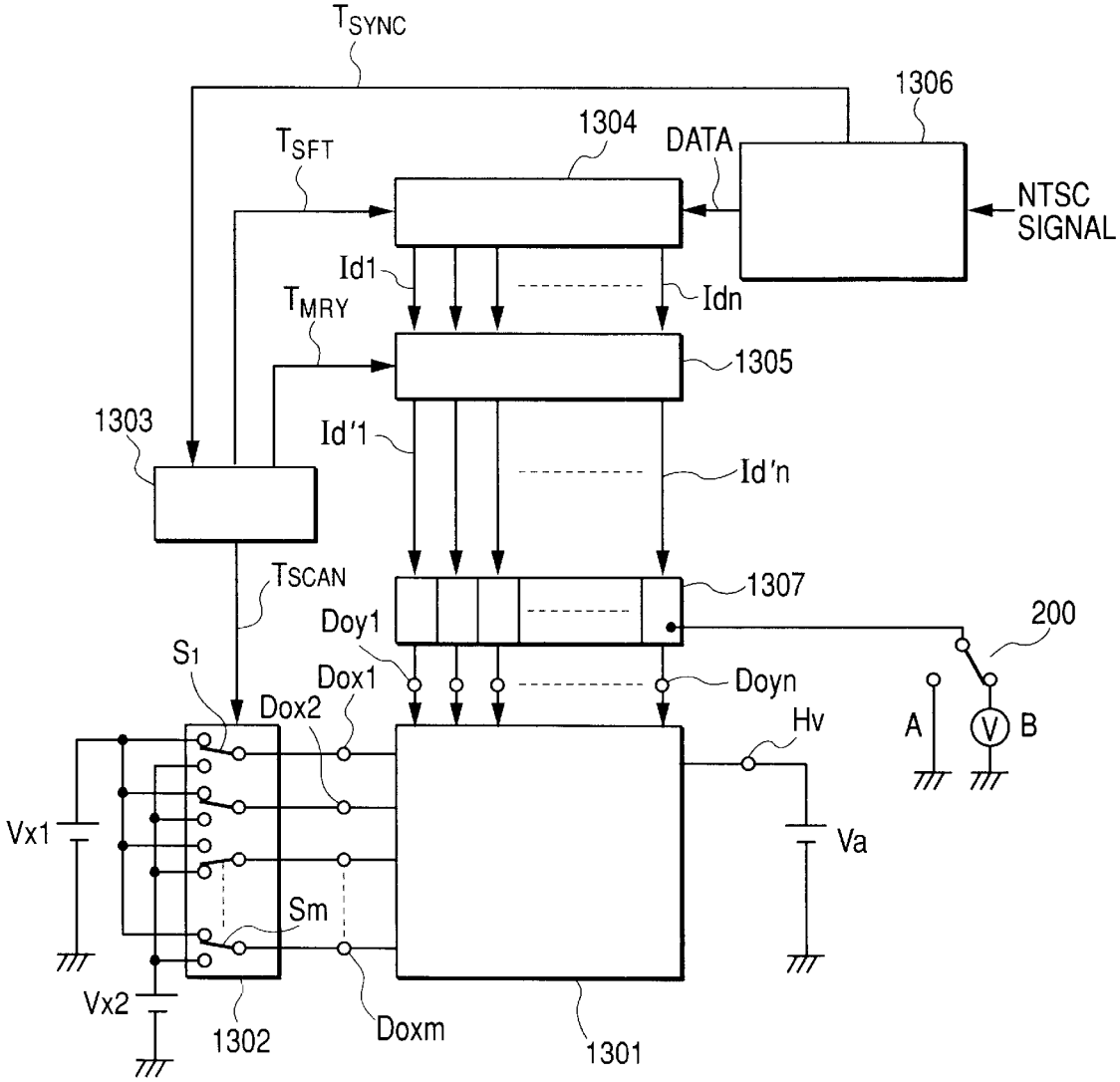
FIG. 9 is a block diagram showing the overall arrangement of an image-forming apparatus according to Example 4 of the present invention.

The electron-emitting devices in Example 2 were arranged according to the matrix wiring shown in FIG. 12, and the image-forming apparatus shown in FIG. 6 was formed. The pixel size of each device was set to x=300 μm and y=300 μm. A phosphor was placed above each device. In addition, as shown in FIG. 9, this apparatus incorporated a circuit 200 capable of selecting a voltage for $V_{2off}$. This circuit allows a user to operate a switch to select a voltage. In the case of battery driving, for example, the user turned the switch to the A side to set $V_{2off}$ to a ground potential to set a low-power state at the expense of image quality. A method of setting a ground potential can be implemented by connecting the A-side terminal of the switch to the housing of the image-forming apparatus (a member set to the ground potential). In the image quality mode, the user sets the switch to the B side to set the voltage $V_{2off}$ to −4 V, thereby obtaining higher image quality.

EXAMPLE 5

Example 5 of the present invention will be described next.

Figure 10:
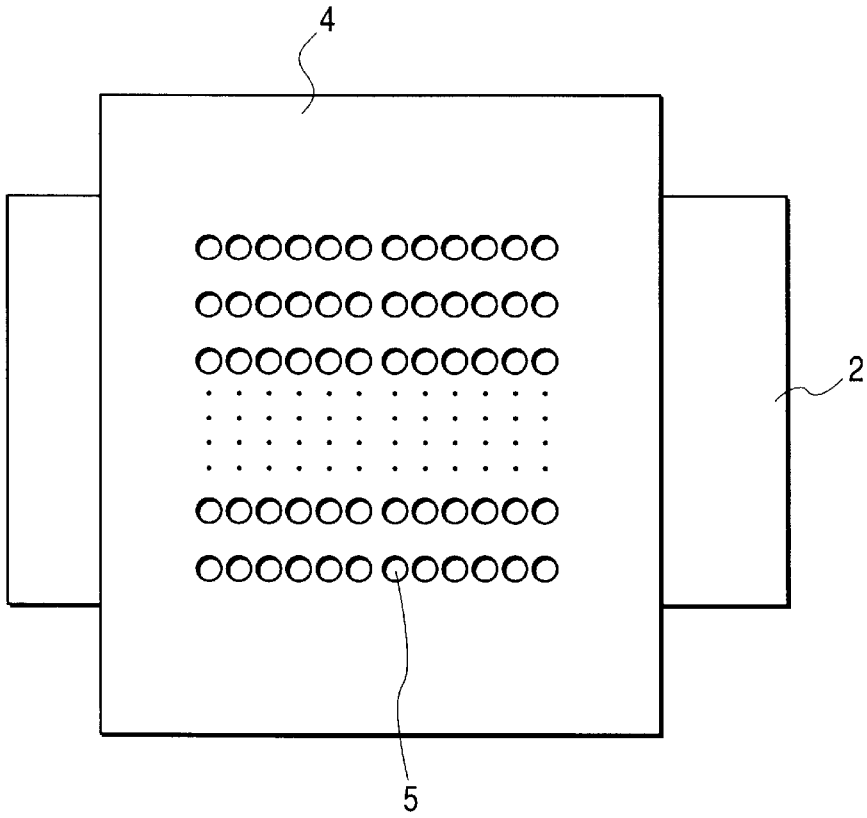
FIG. 10 is a view showing an example of an electron-emitting device according to Example 5 of the present invention.

In this example, as shown in FIG. 10, a plurality of electron-emitting devices were formed in one pixel, and large intersection areas were set between scanning lines and signal lines, thus setting large electron-emitting areas. This made it possible to improve the electron-emitting efficiency and decrease the voltage required to obtain a necessary electric field, thus reducing the power consumption. $V_{1on}$=0 V, $V_{1off}$=20 V, $V_{2on}$=10 V, and $V_{2off}$=0 V. The capacitance formed by the signal lines and scanning lines was as large as about ¾ the overall capacitance of the scanning lines. When the voltage of all the signal lines changed by 10 V, the voltage of each scanning line dropped by 7.5 V. However, since $V_{1off}$ was initially risen to 20 V, it became 12.5 V even if a voltage drop of 7.5 V occurred. This was higher than the ON voltage, 10 V, of the scanning line by 2.5 V, and hence a complete OFF state was set, thereby obtaining an image with high quality and good contrast.

EXAMPLE 6

Example 6 of the present invention will be described next. In this example, each electron-emitting device has the structure shown in FIGS. 11A and 11B.

Figure 11A:
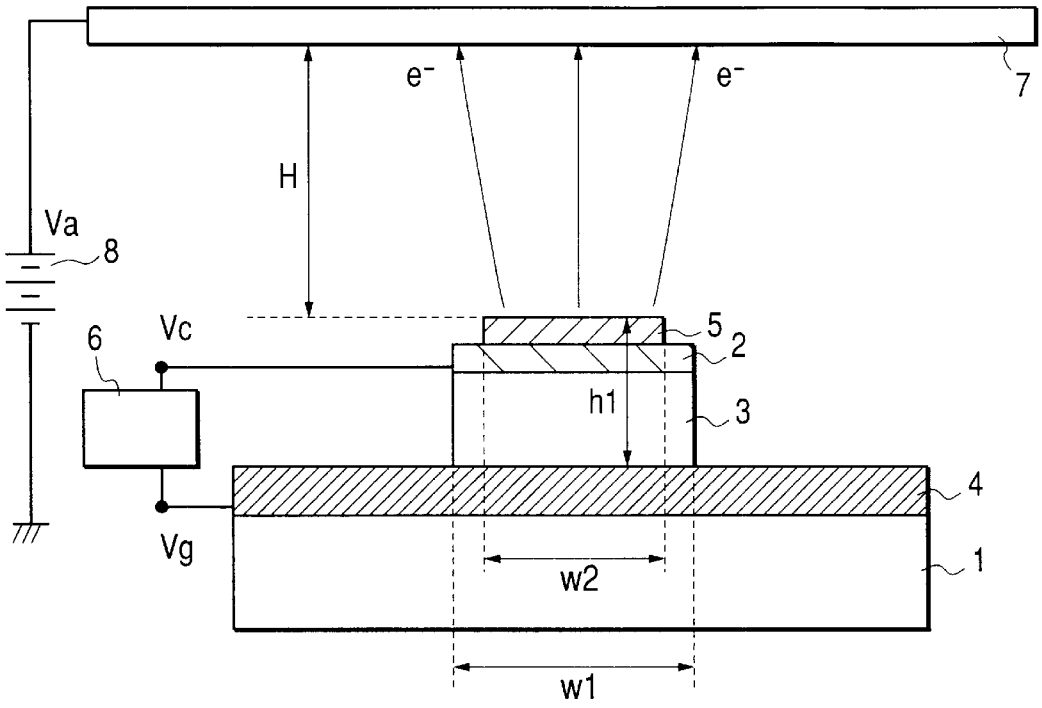
FIGS. 11A and 11B are schematic views showing another example of the electron-emitting device which can be applied to the present invention.
Figure 11B:
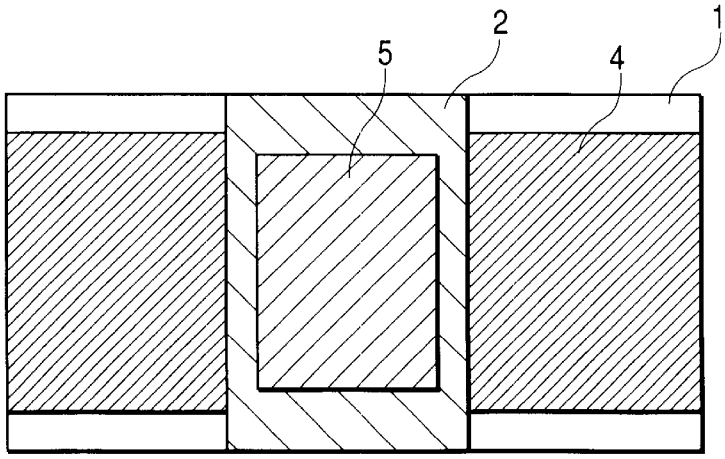

FIGS. 11A and 11B are a sectional view and plan view of an electron-emitting device formed in this example. An electron-emitting layer 5 is formed on the uppermost portion. In each electron-emitting device according to this example, a gate electrode 4 is formed on a substrate 1, and a dielectric layer 3 is formed on the gate electrode 4. In addition, a cathode electrode 2 is formed on the dielectric layer 3, and the electron-emitting layer 5 is formed on the cathode electrode 2. In the case shown in FIGS. 11A and 11B, the electron-emitting layer 5 is formed on the cathode electrode 2. However, if the electron-emitting layer 5 has a sufficiently low resistance, the electron-emitting layer 5 may also serve as a cathode electrode. In the case of this convex structure, w1 corresponds to the width of the dielectric layer 3 in a direction substantially parallel to the surface of the substrate 1, and hi corresponds to the distance from the upper surface of the gate electrode 4 to the upper surface of the electron-emitting layer.

The material and size of each electron-emitting device conformed to those in Example 1, and w1=3 μm. Note that the cathode electrode 2 was 100 nm thick, the dielectric layer 3 was 500 nm thick, and the gate electrode 4 was 2 μm thick. In addition, the electron-emitting layer was not formed on the entire surface of the upper portion of the anode electrode but was formed to have a width w2, 2 μm in this example. In this example, although the gate electrode 4 exists on a lower portion through the dielectric layer 3, the same effect can be obtained by applying the same potential as that of an electron-emitting device which can be applied to the present invention.

EXAMPLE 7

FIGS. 1A and 1B are a plan view and sectional view of an electron-emitting device manufactured in this example. FIGS. 5A to 5F show an example of the method of manufacturing the electron-emitting device according to this example. The electron-emitting device of this embodiment is formed in the same manner as in the first embodiment.

Electron-emitting devices each manufactured in the above manner were arranged with H=2 mm as in FIGS. 1A and 1B and were driven in the manner shown in FIG. 3. In this example, a cathode electrode 2 is connected to a signal line 63, and a gate electrode 4 is connected to a scanning line 62. Va=10 kV, $V_{1on}$=20 V, $V_{1off}$=−20 V, $V_{2on}$=0 V, and $V_{2off}$=20 V. As Comparative Example 1, consider a case where $V_{1off}$=0 V. A scanning line and signal line each had a capacitance of 10 pF, and the number of scanning lines and signal lines required to form QVGA pixels were 240×320 (960 RGB pixels). The total capacitance of the scanning lines was about ½ that of the signal lines and scanning lines. When the potential of all the signal lines changed by 20 V, the voltage of each scanning line rose by 10 V. In this example, even if the potential of the scanning line rose by 10 V, since $V_{1off}$=−20 V, the potential of each scanning line became only −10 V, and the potential of the electron-emitting device became −10 V and hence was kept OFF.

In this case, an electrode coated with a phosphor was used as an anode, and the size of an electron beam was observed. In this case, the size of an electron beam was the size of an electron beam up to a region where the intensity was 10% of the peak luminance of the phosphor that emitted light. As a result, electron beams in the ON state in both the cases were equal to each other, i.e., 150 μm.

In the comparative example, when the potential of the scanning line 62 dropped by 10 V due to the signal line, a voltage of 10 V was applied to the electron-emitting device. Consequently, light emission was confirmed and a great deterioration in image quality was observed. In contrast to this, when the device was driven by the driving method according to this example, an electron emission current Ie in the OFF state became 1/100 or less that in the ON state, and hence no light emission from the phosphor was observed.

EXAMPLE 8

A driving method according to this example will be described below.

In contrast to Example 7, in this example, $V_{2off}$ as set to 24 V. In this case, since the voltage of a scanning line Dx1 rose by $V_{2on}-V_{2off}$, i.e., 24 V, the potential rise was about 12 V at maximum, and about (32 V)−(24 V), i.e., about 8 V, was applied to each OFF pixel within Dx1. As compared with 10 V in the prior art, the current was reduced by two orders of magnitude, resulting in a great improvement in image quality. However, the power consumption increased 1.5 times. This is because the driving voltage for the signal line rose from 20 V to 24 V. This method is especially effective for a case where a high priority is given to image quality, and an increase in power consumption can be tolerated.

EXAMPLE 9

Unlike Example 7, diodes were connected to the surroundings of a scanning wiring arrangement to prevent the voltage from becoming 20 V or higher for a long period of time. $V_{2off}$ was set to 20 V. In this case, since the voltage rise at a scanning line Dx1 was $V_{2off}-V_{2on}$, i.e., 20 V, the potential rise due to capacitive coupling was about ½ the above voltage drop, i.e., 10 V at maximum. However, since a diode is connected to a scanning line Dx1, the potential settled down at 20 V in a relatively early stage, thus greatly improving image quality.

EXAMPLE 10

The electron-emitting devices of Example 8 were arranged according to the matrix wiring shown in FIG. 12 to form the image-forming apparatus shown in FIG. 6. The pixel size of each device was set to x=300 μm and y=300 μm. A phosphor was placed above each device. In addition, as shown in FIG. 9, this apparatus incorporated a circuit 200 capable of selecting a voltage for $V_{2off}$. This circuit allows a user to operate a switch to select a voltage. In the case of battery driving, for example, the user turned the switch to the A side to set a low-power state at the expense of image quality. In the image quality mode, the user sets the switch to the B side to set the voltage $V_{2off}$ to 24 V, thereby obtaining higher image quality.

As has been described above, by using the driving method of the present invention, an electron source can be properly driven, which is comprised of electron-emitting devices each generating an electron beam with a small diameter, having a large electron-emitting area, manufactured by an easy manufacturing process, and capable of efficiently emitting electrons at a low voltage.

By applying such an electron source to an image-forming apparatus, an image-forming apparatus capable of generating a high-quality, high-resolution image can be realized.

What is claimed is:

1. A method of driving an electron source in which electron-emitting devices, each having a gate electrode and cathode electrode, are arranged in a matrix, comprising the steps of:

applying, to an anode electrode formed above the electron-emitting device, a potential higher than a potential applied to the gate and cathode electrodes;

controlling an electron emission amount from the electron-emitting device by modulating a potential difference between the cathode electrode and the gate electrode and selecting one of a plurality of first-directional wirings in one of an X direction and a Y direction in which the cathode electrodes of a plurality of electron-emitting devices which are arranged on one side of the same row or column are commonly connected; and driving a plurality of second-directional wirings together in the other of the X direction and the Y direction in which the gate electrodes of the plurality of electron-emitting devices which are arranged on the other side of the same row or column are commonly connected, wherein letting $V_{1off}$ be an OFF voltage of the first-directional wiring, and $V_{2on}$ be an ON voltage of the second-directional wiring, $V_{1off}>V_{2on}$ is satisfied.

2. The method according to claim 1, wherein letting $V_{2off}$ be an OFF voltage of the second-directional wiring, C1 be a total capacitance of the first-directional wirings and the second-directional wirings, and CO be a total capacitance of the first-directional wirings, $V_{1off}-V_{2on}\geqq(V_{2on}-V_{2off})\times C1/CO$.

3. The method according to claim 1, wherein $2V_{2on}-V_{1off}-V_{2off}\leqq 0$.

4. The method according to claim 1, wherein letting $V_{1on}$ be an ON voltage of the first-directional wiring, $V_{1on}>V_{2off}$ and $V_{1off}-V_{2on}>V_{1on}-V_{2off}$.

5. The method according to claim 1, wherein the electron-emitting device is a thin film and placed substantially parallel to the anode electrode.

6. The method according to claim 1, wherein the electron-emitting device is placed within an intersection area between the first-directional wiring and the second-directional wiring.

7. The method d of driving an image-forming apparatus having an electron source made of a plurality of electron-emitting devices and an image-forming member for forming an image by using electrons emitted from the electron-emitting devices, wherein the electron source is driven by the driving method defined in any one of claims 1 to 6.

8. The method according to claim 7, wherein the electron-emitting devices are time-divisionally driven to express a grayscale image.

9. The method according to claim 7, wherein the image-forming member is a phosphor.

10. A method of driving an electron source in which electron-emitting devices, each having a gate electrode and cathode electrode, are arranged in a matrix, comprising the steps of:

applying a predetermined potential to an anode electrode formed above the electron-emitting device;

controlling an electron emission amount of the electron-emitting device by modulating a potential between the cathode electrode and the gate electrode and selecting one of a plurality of first-directional wirings in one of an X direction and a Y direction in which the gate electrodes of a plurality of electron-emitting devices which are arranged on one side of the same row or column are commonly connected; and driving a plurality of second-directional wirings together in the other of the X direction and the Y direction in which the cathode electrodes of the plurality of electron-emitting devices which are arranged on the other side of the same row or column are commonly connected, wherein letting $V_{1off}$ be an OFF voltage of the first-directional wiring, and $V_{2on}$ be an ON voltage of the second-directional wiring, $V_{1off}<V_{2on}$ is satisfied.

11. The method according to claim 10, wherein letting $V_{2off}$ be an OFF voltage of the second-directional wiring, C1 be a total capacitance of the first-directional wirings and the second-directional wirings, and CO be a total capacitance of the first-directional wirings, $V_{2on}-V_{1off}\geqq(V_{2off}-V_{2on})\times C1/CO$.

12. The method according to claim 11, wherein $2V_{2on}-V_{1off}-V_{2off}\geqq 0$.

13. The method according to claim 10, wherein letting $V_{1on}$ be an ON voltage of the first-directional wiring, $V_{1on}<V_{2off}$ and $V_{1off}-V_{2on}<V_{1on}-V_{2off}$.

14. The method according to claim 10, wherein the electron-emitting device is a thin film and placed substantially parallel to the anode electrode.

15. The method according to claim 10, wherein the electron-emitting device is placed within an intersection area between the first-directional wiring and the second-directional wiring.

16. The method of driving an image-forming apparatus having an electron source made of a plurality of electron-emitting devices and an image-forming member for forming an image by using electrons emitted from the electron-emitting devices, wherein the electron source is driven by the driving method defined in any one of claims 10 to 15.

17. The method according to claim 16, wherein the electron-emitting devices are time-divisionally driven to express a grayscale image.

18. The method according to claim 16, wherein the image-forming member is a phosphor.

19. The method of driving an electron source comprising a plurality of electron-emitting devices, each comprising a gate electrode and a cathode electrode, a plurality of row-directional wirings, and a plurality of column-directional wirings, the cathode electrode being connected one of the plurality of row-directional wirings, and the gate electrode being connected to one of the plurality of column-directional wirings, wherein selecting at least one row-directional wiring from the plurality of row-directional wirings, and applying a voltage $V_{1on}$ to the selected wiring, while selecting at least one column-directional wiring from the plurality of column-directional wirings, and applying a voltage $V_{2on}$ to the selected wiring, wherein a voltage $V_{1off}$ is applied to each unselected wiring of the plurality of row-directional wirings, and a voltage $V_{2off}$ is applied to each unselected wiring of the plurality of column-directional wirings, and $V_{1off}>V_{2on}>V_{1on}$ is satisfied.

20. The method according to claim 19, wherein $V_{2on}>V_{2off}$ is satisfied.

21. The method according to claim 19, wherein $V_{1off}>V_{2on}>V_{1on}\geqq V_{2off}$ is satisfied.

22. The method according to claim 19, wherein the row-directional wiring to which the voltage $V_{1on}$ is to be applied is sequentially switched to adjacent row-directional wirings.

23. The method according to claim 22, wherein before the voltage $V_{1on}$ is applied to the row-directional wiring to which the voltage $V_{1on}$ has been applied, the voltage $V_{1on}$ is applied once to each of the remaining row-directional wirings.

24. The method according to claim 19, wherein the number of row-directional wirings to which the voltage $V_{1on}$ is simultaneously applied is constant.

25. The method of driving an image-forming apparatus comprising an electron source and an image-forming member, wherein the electron source is driven by the driving method defined in any one of claims 19 to 24.

26. The method of driving an electron source comprising a plurality of electron-emitting devices, each comprising a gate electrode and a cathode electrode, a plurality of row-directional wirings, and a plurality of column-directional wirings, the cathode electrode being connected one of the plurality of column-directional wirings, and the gate electrode being connected to one of the plurality of row-directional wirings, comprising:

selecting at least one row-directional wiring from the plurality of row-directional wirings, and applying a voltage $V_{1on}$ to the selected wiring, while selecting at least one column-directional wiring from the plurality of column-directional wirings, and applying a voltage $V_{2on}$ to the selected wiring, wherein a voltage $V_{1off}$ is applied to each unselected wiring of the plurality of row-directional wirings, and a voltage $V_{2off}$ is applied to each unselected wiring of the plurality of column-directional wirings, and $V_{1off}<V_{2on}<V_{1on}$ is satisfied.

27. The method according to claim 26, wherein $V_{2on}<V_{2on}$ is satisfied.

28. The method according to claim 26, wherein $V_{1off}<V_{2on}<V_{1on}\leqq V_{2off}$ is satisfied.

29. The method according to claim 26, wherein the row-directional wiring to which the voltage $V_{1on}$ is to be applied is sequentially switched to adjacent row-directional wirings.

30. The method according to claim 29, wherein before the voltage $V_{1on}$ is applied to the row-directional wiring to which the voltage $V_{1on}$ has been applied, the voltage $V_{1on}$ is applied once to each of the remaining row-directional wirings.

31. The method according to claim 26, wherein the number of row-directional wirings to which the voltage $V_{1on}$ is simultaneously applied is constant.

32. The method of driving an image-forming apparatus comprising an electron source and an image-forming member, wherein the electron source is driven by the driving method defined in any one of claims 26 to 31.

33. The method of manufacturing an electron source, comprising the steps of:

(A) preparing an electron source comprising a plurality of electron-emitting devices, each comprising a gate electrode and a cathode electrode, a plurality of row-directional wirings, and a plurality of column-directional wirings, the cathode electrode being connected one of the plurality of row-directional wirings, and the gate electrode being connected to one of the plurality of column-directional wirings; and (B) connecting a means for applying a voltage to the plurality of row-directional wirings and the plurality of column-directional wirings, wherein the means for applying the voltage selects at least one row-directional wiring from the plurality of row-directional wirings and applies a voltage $V_{1on}$ to the selected wiring while selecting at least one column-directional wiring from the plurality of column-directional wirings and applying a voltage $V_{2on}$ to the selected wiring, a voltage $V_{1off}$ is applied to each unselected wiring of the plurality of row-directional wirings and a voltage $V_{2off}$ is applied to each unselected wiring of the plurality of column-directional wirings, and $V_{1off}>V_{2on}>V_{1on}$ is satisfied.

34. The method according to claim 33, wherein $V_{1off}>V_{2on}>V_{1on}\geqq V_{2off}$ is satisfied.

35. The method of manufacturing an image-forming apparatus, comprising the steps of:

(A) preparing a first substrate having an electron source comprising a plurality of electron-emitting devices, each comprising a gate electrode and a cathode electrode, a plurality of row-directional wirings, and a plurality of column-directional wirings, the cathode electrode being connected one of the plurality of row-directional wirings, and the gate electrode being connected to one of the plurality of column-directional wirings;

(B) preparing a second substrate having a phosphor;

(C) arranging the first and second substrates to oppose each other and holding a space between the first and second substrates in a pressure reduced state; and (D) connecting a means for applying a voltage to the plurality of row-directional wirings and the plurality of column-directional wirings, wherein the means for applying the voltage selects at least one row-directional wiring from the plurality of row-directional wirings and applies a voltage $V_{1on}$ to the selected wiring while selecting at least one column-directional wiring from the plurality of column-directional wirings and applying a voltage $V_{2on}$ to the selected wiring, a voltage $V_{1off}$ is applied to each unselected wiring of the plurality of row-directional wirings and a voltage $V_{2off}$ is applied to each unselected wiring of the plurality of column-directional wirings, and $V_{1off}>V_{2on}>V_{1on}$ is satisfied.

36. The method according to claim 35, wherein $V_{1off}>V_{2on}>V_{1on}\geqq V_{2off}$ is satisfied.

37. A method of manufacturing an electron source, comprising the steps of:

(A) preparing an electron source comprising a plurality of electron-emitting devices, each comprising a gate electrode and a cathode electrode, a plurality of row-directional wirings, and a plurality of column-directional wirings, the gate electrode being connected one of the plurality of row-directional wirings, and the cathode electrode being connected to one of the plurality of column-directional wirings; and (B) connecting a means for applying a voltage to the plurality of row-directional wirings and the plurality of column-directional wirings, wherein the means for applying the voltage selects at least one row-directional wiring from the plurality of row-directional wirings and applies a voltage $V_{1on}$ to the selected wiring while selecting at least one column-directional wiring from the plurality of column-directional wirings and applying a voltage $V_{2off}$ to the selected wiring, a voltage $V_{1off}$ is applied to each unselected wiring of the plurality of row-directional wirings and a voltage $V_{2off}$ is applied to each unselected wiring of the plurality of column-directional wirings, and $V_{1off}<V_{2on}<V_{1on}$ is satisfied.

38. The method according to claim 37, wherein $V_{1off}<V_{2on}<V_{1on}=V_{2off}$ is satisfied.

39. The method of manufacturing an image-forming apparatus, comprising the steps of:

(A) preparing a first substrate having an electron source comprising a plurality of electron-emitting devices, each comprising a gate electrode and a cathode electrode, a plurality of row-directional wirings, and a plurality of column-directional wirings, the gate electrode being connected one of the plurality of row-directional wirings, and the cathode electrode being connected to one of the plurality of column-directional wirings;

(B) preparing a second substrate having a phosphor;

(C) arranging the first and second substrates to oppose each other and holding a space between the first and second substrates in a depressurized state; and (D) connecting a means for applying a voltage to the plurality of row-directional wirings and the plurality of column-directional wirings, wherein the means for applying the voltage selects at least one row-directional wiring from the plurality of row-directional wirings and applies a voltage $V_{1on}$ to the selected wiring while selecting at least one column-directional wiring from the plurality of column-directional wirings and applying a voltage $V_{2on}$ to the selected wiring, a voltage $V_{1off}$ is applied to each unselected wiring of the plurality of row-directional wirings and a voltage $V_{2off}$ is applied to each unselected wiring of the plurality of column-directional wirings, and $V_{1off}<V_{2on}<V_{1on}$ is satisfied.

40. The method according to claim 39, wherein $V_{1off}<V_{2on}<V_{1on}\leqq V_{2off}$ is satisfied.

* * * * *

UNITED STATES PATENT AND TRADEMARK OFFICE

CERTIFICATE OF CORRECTION

PATENT NO. : 6,583,582 B2
DATED : June 24, 2003
INVENTOR(S) : Takeshi Ichikawa

It is certified that error appears in the above-identified patent and that said Letters Patent is hereby corrected as shown below:

Title page,
Item [56], References Cited, U.S. PATENT DOCUMENTS, "6,169,528 B1 1/2001 Oguchi et al." should read -- 6,169,528 B1 2/2001 Oguchi et al. --.
Item [57], ABSTRACT,
Line 13, "$V_{1off}>V_{2on}$— ." should read -- $V_{1off}>V_{2on}$. --; and
Line 15, "due" should read -- due to --.

Column 4,
Line 65, "the scanning" should read -- the --.

Column 5,
Line 4, "line" should read -- lines --.

Column 6,
Line 10, "to th e" should read -- to the --;
Line 11, "prese n t" should read -- present --;
Line 15, "elec trode" should read -- electrode --; and
Line 26, "electrode s" should read -- electrodes --.

Column 7,
Line 58, "connected one" should read -- connected to one --.

Column 8,
Lines 8, 28 and 51, "connected one" should read -- connected to one --.

Column 9,
Line 2, "$V_{1off}>V_{2on}>V_{2on}$" should read -- $V_{1off}>V_{2on}>V_{1on}$ --;
Lines 8 and 32, "connected one" should read -- connected to one --; and
Line 49, "$V_{off}<V_{2on}<V_{1on}$" should read -- $V_{1off}<V_{2on}<V_{1on}$ --.

Column 12,
Line 3, "turn on" should read -- turned on --;
Line 19, " $V_{1on}$,"should read -- $V_{1on}$ --. and
Line 26, " $V_{1off}>V_{2on}>V_{1on}>V_{2off}$ " should read -- $V_{1off}>V_{2on}>V_{1on}\geq V_{2off}$ --.

UNITED STATES PATENT AND TRADEMARK OFFICE

CERTIFICATE OF CORRECTION

PATENT NO. : 6,583,582 B2
DATED : June 24, 2003
INVENTOR(S) : Takeshi Ichikawa

It is certified that error appears in the above-identified patent and that said Letters Patent is hereby corrected as shown below:

Column 13,
Line 40, "$V_{1off}<V_{2on}<V_{1on}$," should read -- $V_{1off}<V_{2on}<V_{1on}$ --;
Line 42, "$V_{1on}<V_{2off}$" should read -- $V_{1on}\leq V_{2off}$ --; and
Line 55, "voltage=$V_{off}$+" should read -- voltage=$V_{1off}$+ --.

Column 15,
Line 8, "the a" should read -- the --.

Column 16,
Lines 19, 29 and 37, "fist" should read -- frit --.

Column 18,
Line 21, ".Tsft" should read -- Tsft --;
Line 31, "1d1" should read -- 1'd1 --;
Line 32, "1dn" should read -- 1'dn --; and
Line 36, "1d1 to 1dn." should read -- 1'd1 to 1'dn. --.

Column 20,
Line 34, "equal-to" should read -- equal to --.

Column 22,
Line 1, "hi" should read -- h1 --.

Column 24,
Line 23, "method d" should read – method --.

Column 25,
Lines 19 and 58, "The method" should read -- A method --; and
Lines 23 and 61, "connected one" should read -- connected to one --.

Column 26,
Line 10, "$V_{2on}<V_{2on}$" should read -- $V_{2on}<V_{2off}$ --;
Lines 29 and 57, "The method" should read -- A method --; and
Lines 36 and 64, "connected one" should read -- connected to one --.

Column 27,
Line 29, "connected" should read -- connected to --; and
Line 42, "$V_{2off}$" should read -- $V_{2on}$ --.

UNITED STATES PATENT AND TRADEMARK OFFICE

CERTIFICATE OF CORRECTION

PATENT NO. : 6,583,582 B2
DATED : June 24, 2003
INVENTOR(S) : Takeshi Ichikawa

It is certified that error appears in the above-identified patent and that said Letters Patent is hereby corrected as shown below:

Column 28,
Line 7, "$V_{1off}<V_{2on}<V_{1on}=V_{2off}$" should read -- $V_{1off}<V_{2on}<V_{1on}\leq V_{2off}$ --;
Line 8, "The method" should read -- A method --; and
Line 15, "connected one" should read -- connected to one --.

Signed and Sealed this

Second Day of March, 2004

JON W. DUDAS
*Acting Director of the United States Patent and Trademark Office*